US007874026B2

(12) United States Patent
Gudenkauf

(10) Patent No.: US 7,874,026 B2
(45) Date of Patent: Jan. 25, 2011

(54) SYSTEM AND METHOD FOR RAISING AND LOWERING A BED

(75) Inventor: John G. Gudenkauf, Tucson, AZ (US)

(73) Assignee: Double Space Bed Systems, Inc., Tucson, AZ (US)

( * ) Notice: Subject to any disclaimer, the term of this patent is extended or adjusted under 35 U.S.C. 154(b) by 498 days.

(21) Appl. No.: 11/844,998

(22) Filed: Aug. 24, 2007

(65) Prior Publication Data

US 2009/0049602 A1 Feb. 26, 2009

(51) Int. Cl.
*A47C 17/86* (2006.01)

(52) U.S. Cl. ..... 5/11; 5/2.1; 5/10.1

(58) Field of Classification Search ..... 5/10.1, 5/10.2, 11, 118, 611
See application file for complete search history.

(56) References Cited

U.S. PATENT DOCUMENTS

| | | | | |
|---|---|---|---|---|
| 3,583,310 | A | 6/1971 | Blough | |
| 3,665,527 | A | 5/1972 | Gonzalez | |
| 3,882,554 | A | 5/1975 | Glass | |
| 5,020,169 | A | 6/1991 | Hamada et al. | |
| 5,056,170 | A | 10/1991 | Kronshagen | |
| 5,263,210 | A | 11/1993 | Pollard | |
| 5,363,520 | A | 11/1994 | Lyne, Jr. | |
| 5,377,787 | A | 1/1995 | Chabrier | |
| 5,461,735 | A | 10/1995 | Danton | |
| 5,490,579 | A | 2/1996 | Ratcliffe et al. | |
| 5,502,850 | A | 4/1996 | Lyne, Jr. | |
| 5,687,654 | A | 11/1997 | Huggins | |
| 5,943,714 | A * | 8/1999 | Dignam | 5/10.1 |
| 5,984,404 | A | 11/1999 | Novoa et al. | |
| 6,507,962 | B2 | 1/2003 | Thurston | |
| 6,550,081 | B2 | 4/2003 | Vilsmeier | |
| 6,651,273 | B2 | 11/2003 | Vilsmeier | |
| 6,829,791 | B2 | 12/2004 | Roepke | |
| 6,983,980 | B2 * | 1/2006 | Rasmussen | 296/156 |
| 6,988,760 | B2 | 1/2006 | Rasmussen | |

(Continued)

FOREIGN PATENT DOCUMENTS

WO WO 2004/107922 A1 12/2004

OTHER PUBLICATIONS http://www.alwarriortrailers.com/09photo-fullthrottlefeatures.htm.

(Continued)

*Primary Examiner*—Fredrick Conley
(74) *Attorney, Agent, or Firm*—Hayes Soloway P.C.

(57) ABSTRACT

A new and useful system and method of raising and lowering a bed is provided. A bed system comprises a bed, and a balanced movement system for raising and lowering the bed and for maintaining the bed in a stopped position when application of force to the bed is stopped. The balanced movement system is (i) configured to enable the bed to be raised or lowered by application of force to the bed in a selected direction, and (ii) configured such that when application of the force ceases the bed will come to a stopped position and be maintained in the stopped position by the balanced movement system. In order to raise or lower the bed, a relatively modest force is applied (preferably manually) to the bed in a selected direction.

20 Claims, 18 Drawing Sheets

U.S. PATENT DOCUMENTS

| | | | |
|---|---|---|---|
| 7,121,613 | B1 | 10/2006 | Rasmussen |
| 7,198,313 | B2 | 4/2007 | Baum |
| 7,198,320 | B2 | 4/2007 | Rasmussen |
| 2007/0074342 | A1 | 4/2007 | Kaempfen |

OTHER PUBLICATIONS http://www.espace-loggia.com/index.php?pge=plateau.
http://www.liftbed.com.

* cited by examiner

SYSTEM AND METHOD FOR RAISING AND LOWERING A BED

BACKGROUND

The present invention relates to a new and useful system and method for raising and lowering a bed.

In the applicant's experience, the most well known system for raising and lowering a bed may be a Murphy Bed, which is basically mounted on a pivotal wall and pivots to an open or closed position. To pivot the bed to an open position, the bed must be pulled out from its closed position and that can require a significant effort from a user. Also, the room space that will be taken up by the bed must be cleared when the bed is pulled down to an open position. Additionally, many rooms often make use of bunk beds, which are essentially fixed bed systems that make use of their space only as beds, or loft style beds. The loft style beds use the space below for supplemental furniture but have a limited overhead space and require the use of a ladder to enter the bed, resulting in a cramped, enclosed feel due to the close sleeping approximation to the ceiling in a typical house. These systems do not provide a significant opportunity to enhance the aesthetics of the room in which they are located.

SUMMARY OF THE PRESENT INVENTION

The present invention provides a new and useful system and method for raising and lowering a bed that takes a completely new approach to a bed system, by addressing the aesthetics of the bed system, the ease and efficiency of raising and lowering the bed system manually, and the efficient use of the space used by the bed system.

The bed system is designed to enable a bed to be raised and lowered, by application of a minimal amount of manual force.

In one of its significant features, the bed system and method has a unique balanced movement system (BMS) that makes it efficient for a user to raise and lower the bed, using only manual force, and will keep a bed in any position the bed is in when force is discontinued. Minimal applied force is needed to initiate movement of the bed in either direction. When the force is removed at any point during movement of the bed, the bed simply comes to a stop. This feature is particularly significant when the bed is in its raised position, since the balanced movement system will maintain the bed in its raised position without requiring a latch or other type of additional structure.

The system and method of the invention is designed so that the bed can be raised or lowered with a smooth, even movement which is virtually silent, and in a manner that is not visible to those in the room. Specifically, the bed is raised and lowered without the use of motors, and components are substantially enclosed within bed system furniture, so that the aesthetics of the furniture is preserved.

In addition, with a system and method of the present invention, when the bed is in a raised position, an alcove is provided, with the bottom of the bed providing the ceiling of the alcove. The alcove enables supplemental furniture to be located in the alcove (which enhances the aesthetics and functionality of the system), and the bed can rest on portions of its structural furniture when the bed is in a lowered position. These features of the system make efficient use of space.

The system is designed to maintain accurate, horizontal level movement throughout the vertical travel of the bed, and is designed so that as it moves up or down the bed will stay level. The system is designed so that no operator effort is required to maintain the bed level; regardless of where the operator applies force to raise or lower the bed.

In addition, in the system, according to a preferred embodiment, a modular component is provided that is particularly useful in enabling the system to be effectively and efficiently assembled. Moreover, that modular component has a structure that can be used to form various types of bed systems, irrespective of the style of furniture that is used in the bed system.

The system of the present invention has a number of user friendly features. For example,

- The bed system is designed to fit any standard sized innerspring mattress or the like, making the bed system customizable and enhancing user comfort.
- The bed system is designed to be simple and efficient to operate, needing only to be pulled down or pushed up with minimal force or effort to effect movement of the bed. The force for raising or lowering the bed can be applied anywhere to the bed, and the bed will remain level as the bed is being raised or lowered.
- The preferred system is simple to set up and maintain a weight balance, providing counterweights (which are housed within the bed systems furniture) as part of the balanced movement system and under-mattress flat balance weights to compensate for different weight mattresses and seasonal bedding needs or changes. The under mattress flat weights are used instead of making adjustments to the counterweights for weight compensation, thus eliminating the need to open up or expose the inner workings of the BMS by the end user and essentially making it a safer, more simple system.
- The bed system has no exposed moving parts except for the bed itself, and relatively inconspicuous support pins that extend out of certain furniture components as the bed is being moved between its raised and lowered positions.
- The balanced movement system (BMS) is comprised of heavy duty components built to last a lifetime, with virtually no maintenance required except for roller chain lubrication (when needed, depending upon climate and humidity levels).
- Bedding and mattress changes are made easy by the use of a latch mechanism, which secures the bed platform in the lowered position to assist in these operations.
- Depending on desired supplemental furniture in the alcove area, the bed at lowered position is either at standard bed height, or a height which requires only a 16" stepstool for access. This eliminates the need for a ladder, and allows virtually anyone to use the bed.
- The bed system is a benefit over loft-style and bunk beds for two reasons: a) when the bed is in the raised position, it is higher than a loft or bunk-bed, leaving plenty of space for standing and for supplemental furniture in the alcove area (in fact the bed is as close as possible to the ceiling height of the room in which it is located), and b) when the bed is in the lowered/sleep position, no ladder is required, and there is an open, free space overhead (anti-claustrophobic).
- The preferred form of bed system is free standing, and can efficiently be located in virtually any desired space of a room.
- The bed system support (that includes four columns) has an "open sided" design, which enables the bed system to be located anywhere in a room, and against virtually any type of wall, including a wall with a window.

Other features of the present invention will become further apparent from the following detailed description and the accompanying drawings and exhibits.

BRIEF DESCRIPTION OF THE DRAWINGS AND EXHIBITS

FIG. 1 is a schematic, three dimensional illustration of a balanced movement system for a bed system and method, according to the principles of the present invention;

FIG. 1*a* is a side view of the portion 1*a* of the balanced movement system of FIG. 1;

FIG. 1*b* is a rear view of the portion 1*b* of the balanced movement system of FIG. 1 (that portion 1*b* is also referenced in FIG. 5);

FIG. 1*c* is a view of the portion 1*c* of the balanced movement system of FIG. 1;

FIG. 2 is an exploded partial three dimensional view of certain structural support and furniture components of a bed system, according to the principles of the present invention;

FIG. 2*a* is a fragmentary illustration of portions of the timing components of the bed system, according to the principles of the present invention;

Figure 9:
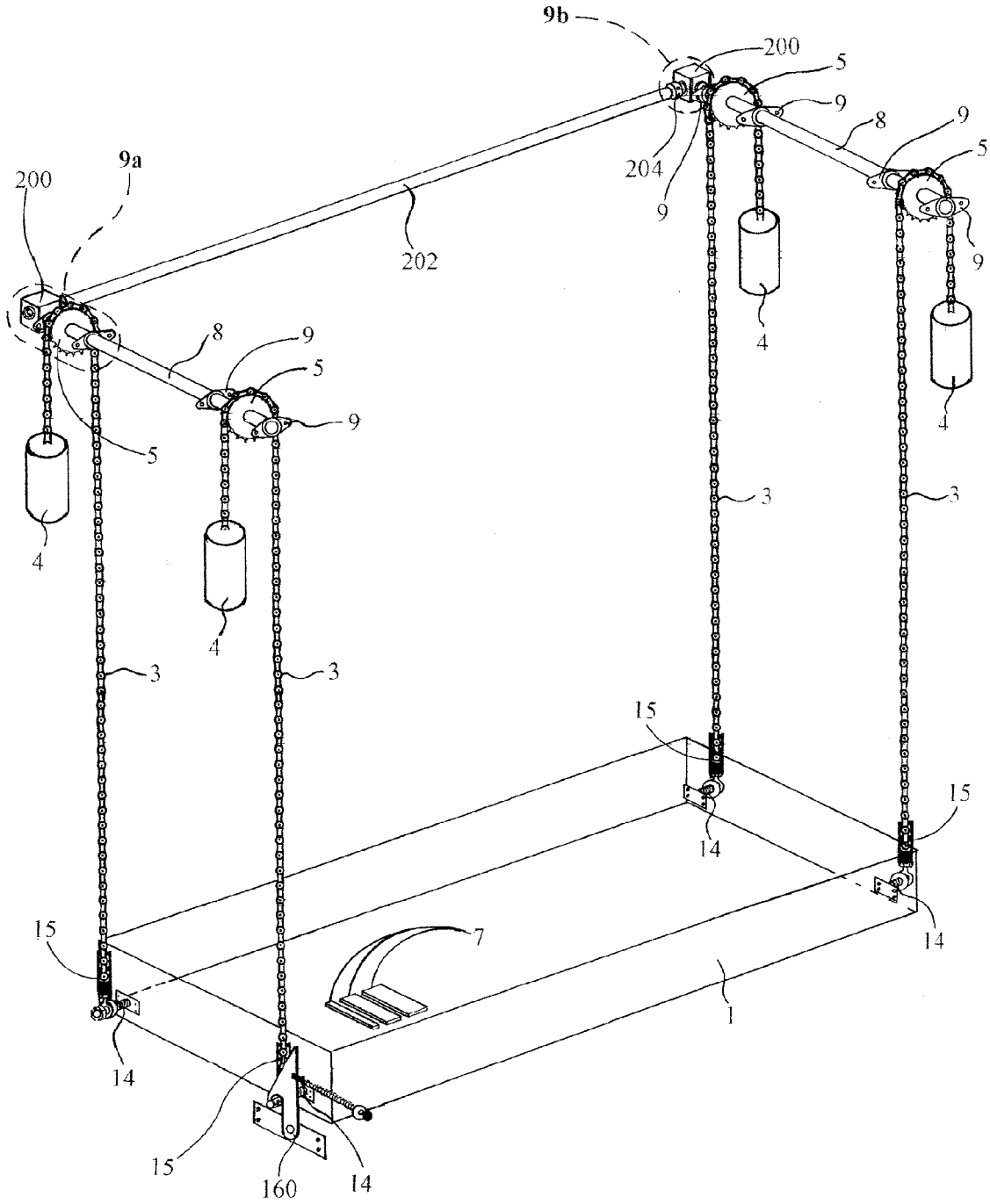
FIG. 9 is a schematic, three dimensional illustration of a balanced movement system for a bed system and method, with an alternative form of timing device, according to the principles of the present invention.
Figure 9A:
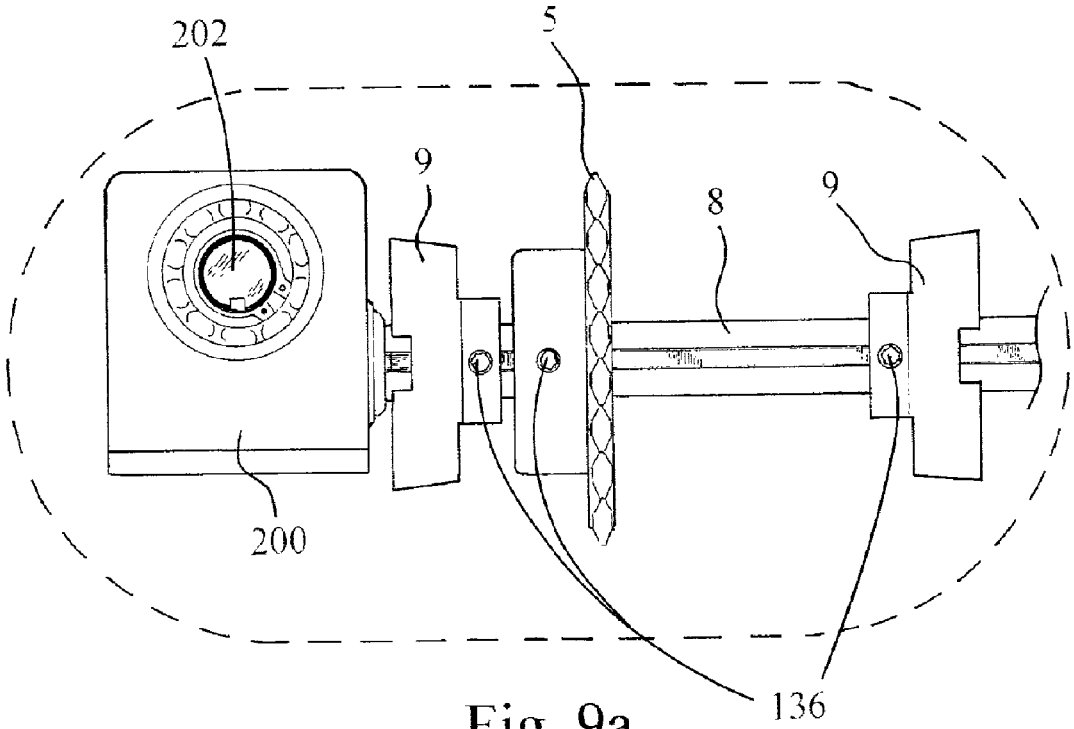
Figure 9B:
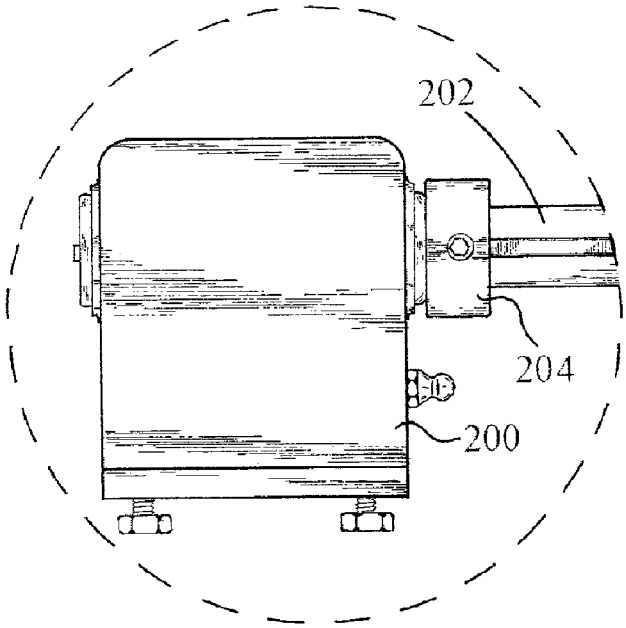
Figure 10:
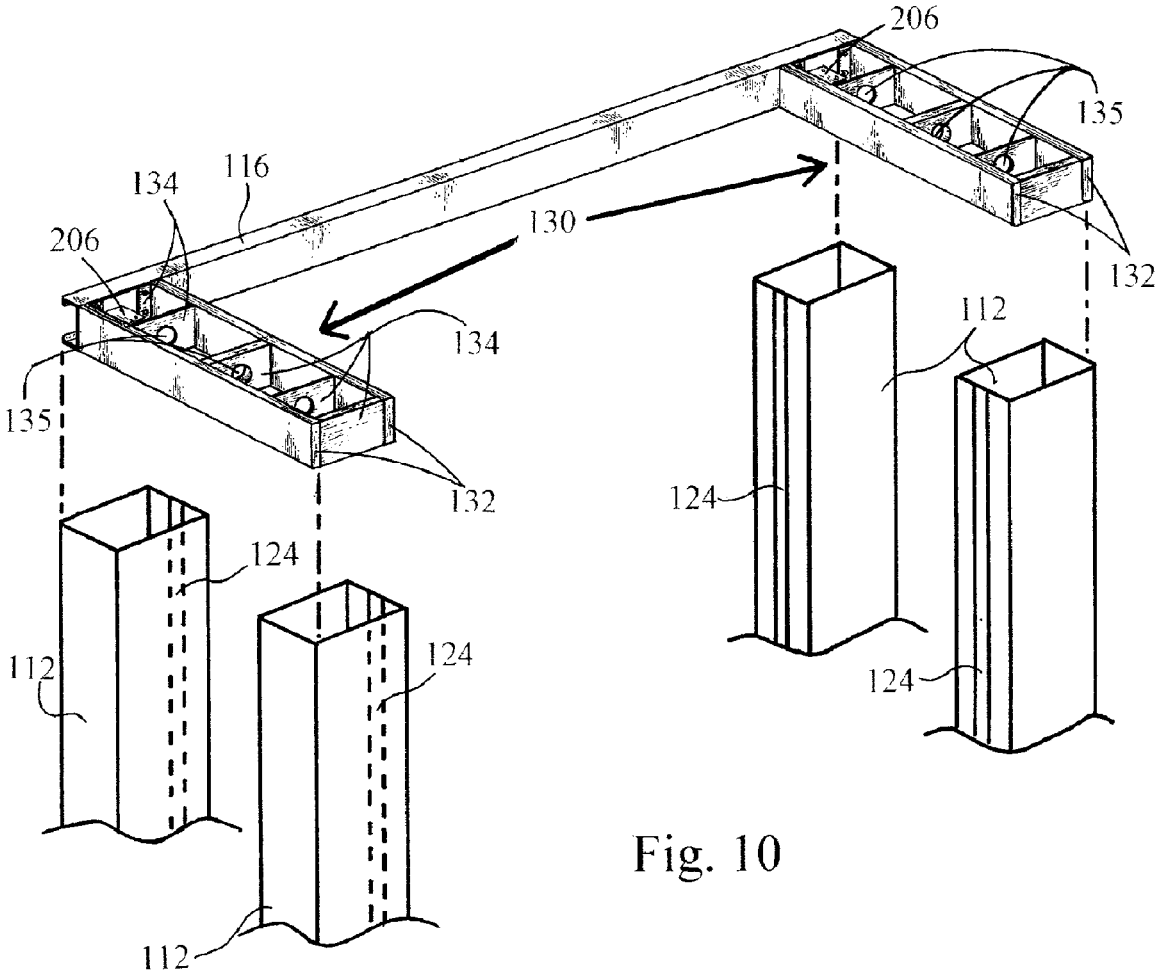
Figure 10A:
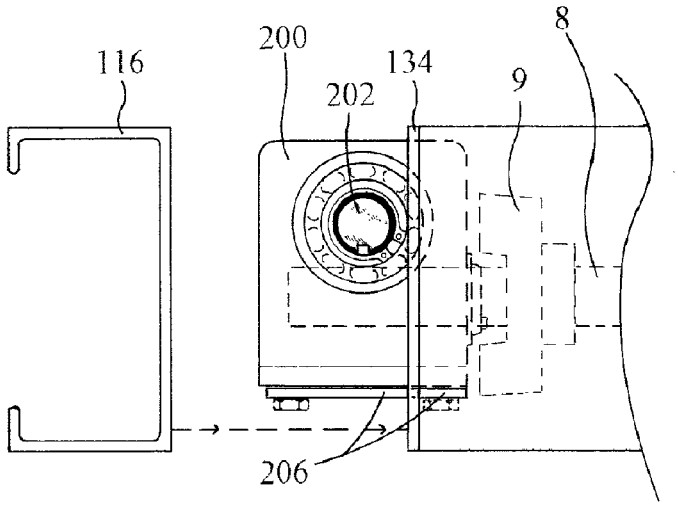
Figure 11:
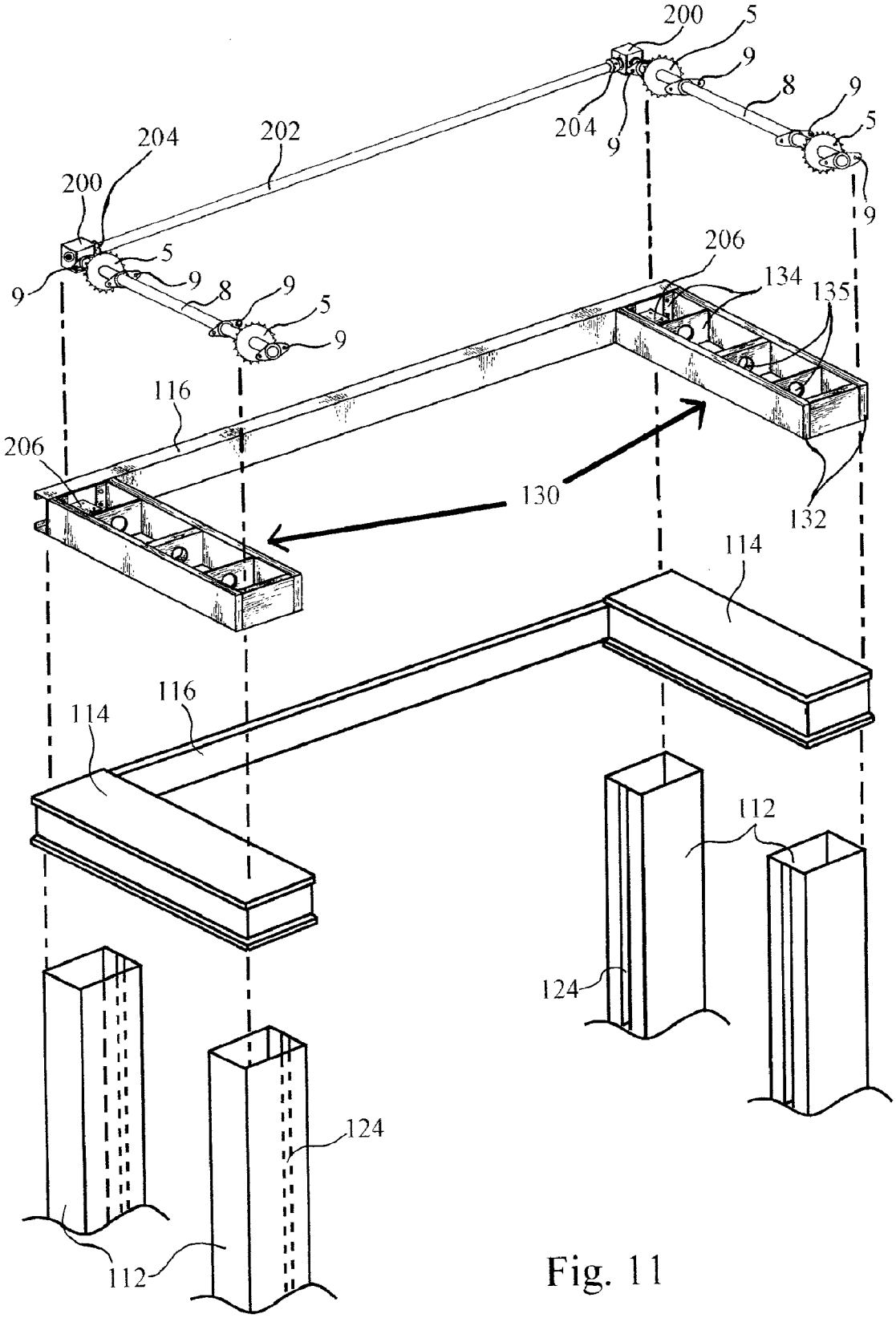
Figure 12:
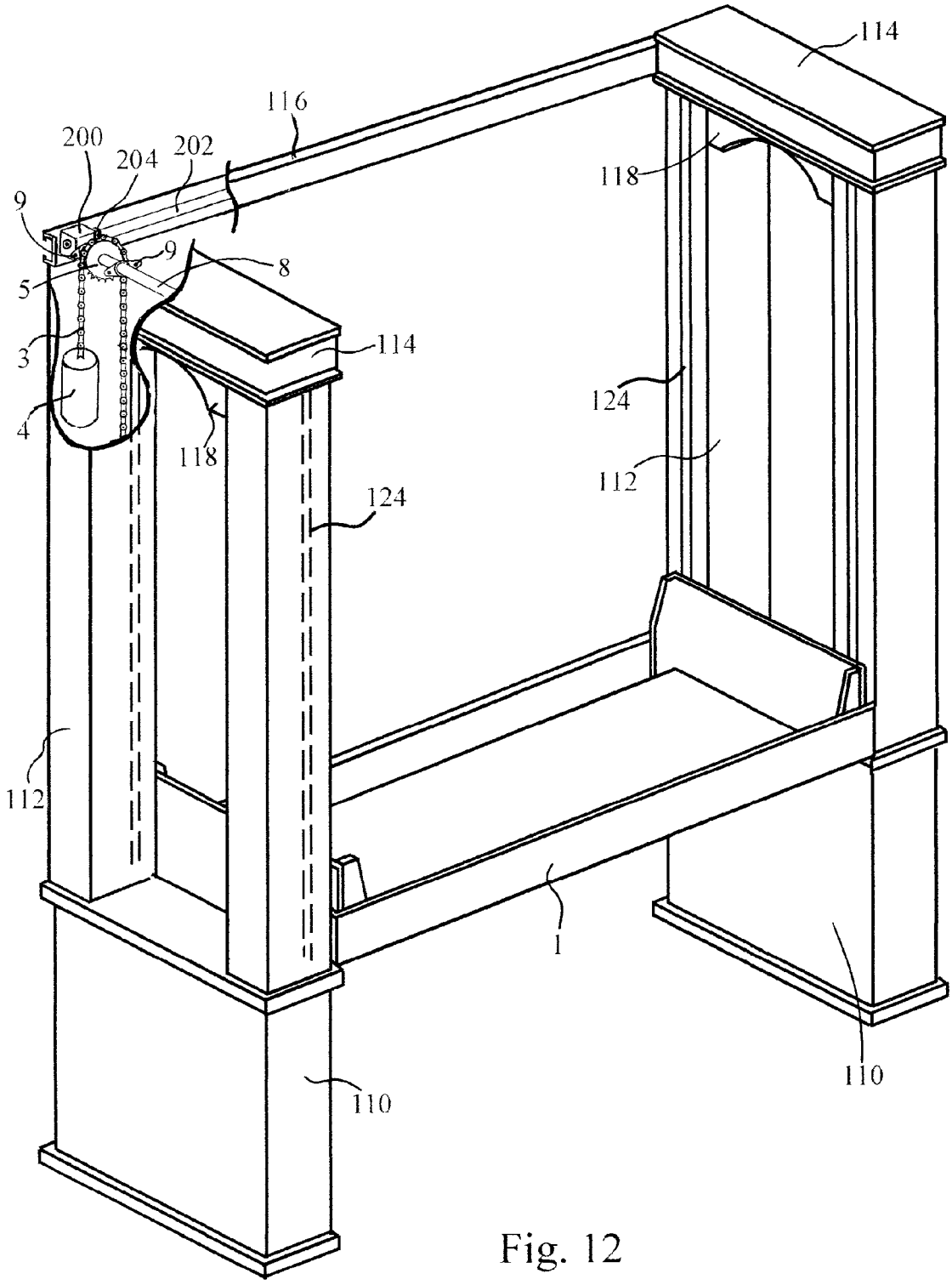
Figure 13:
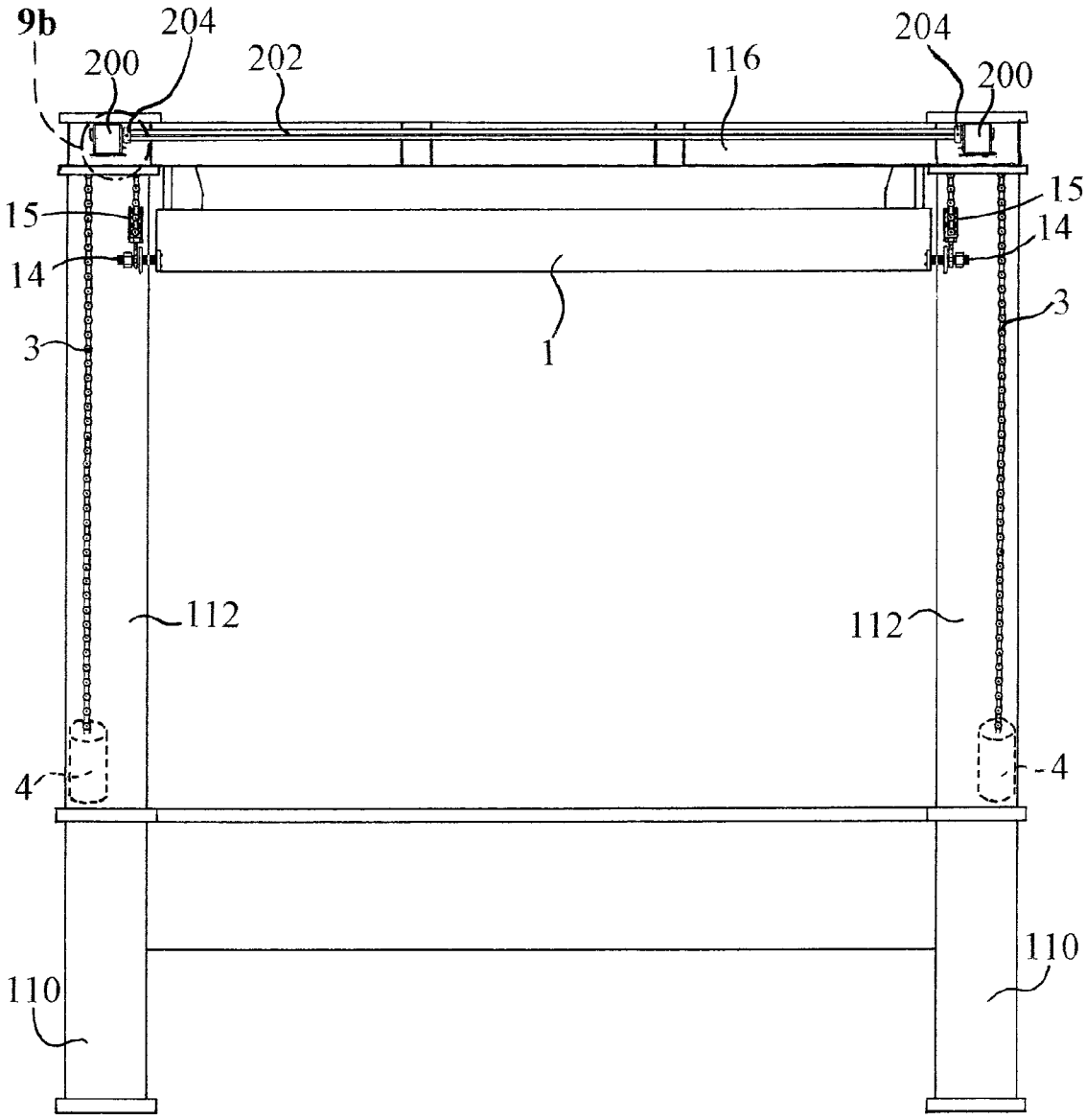
Figure 14:
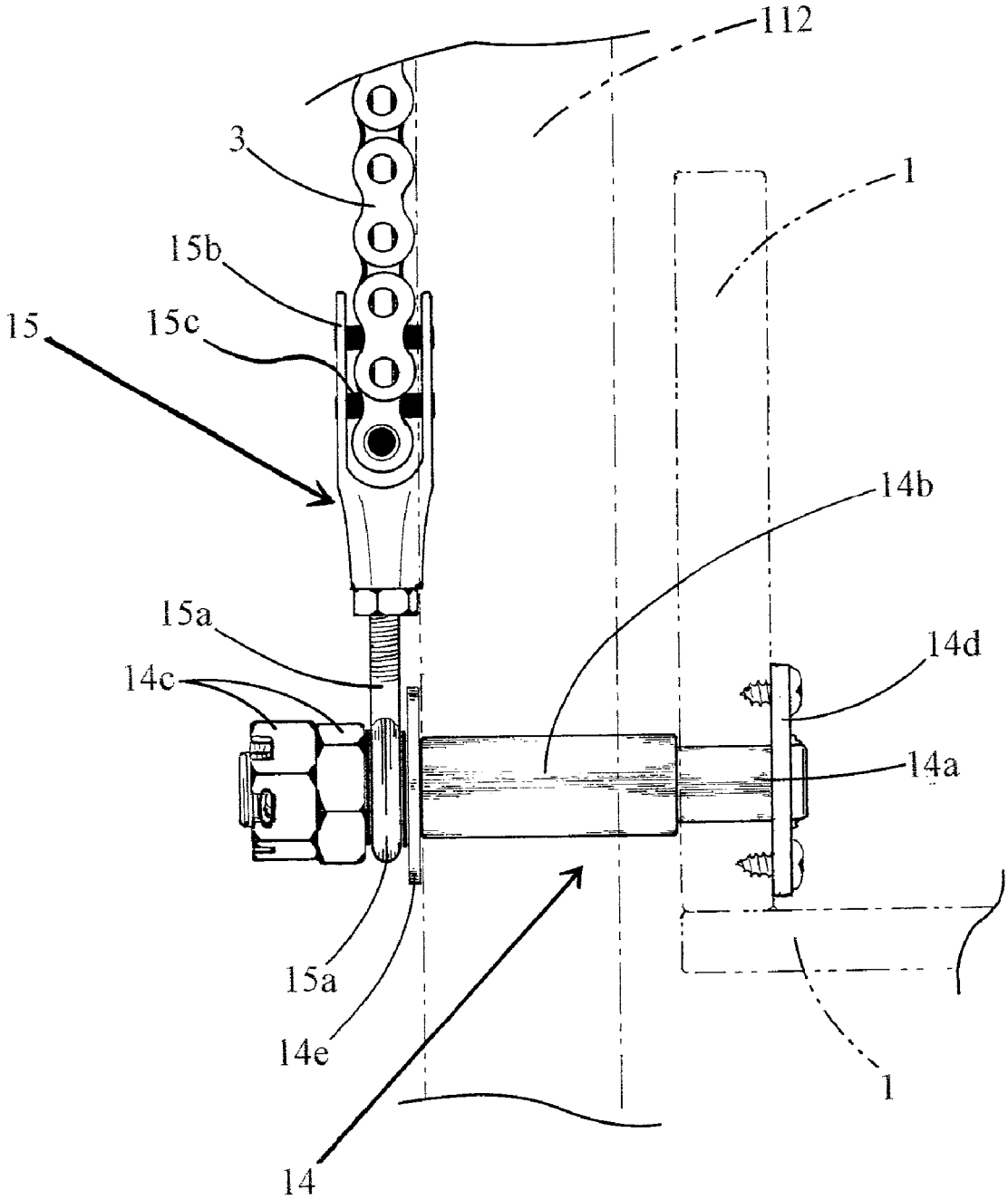
Figure 15:
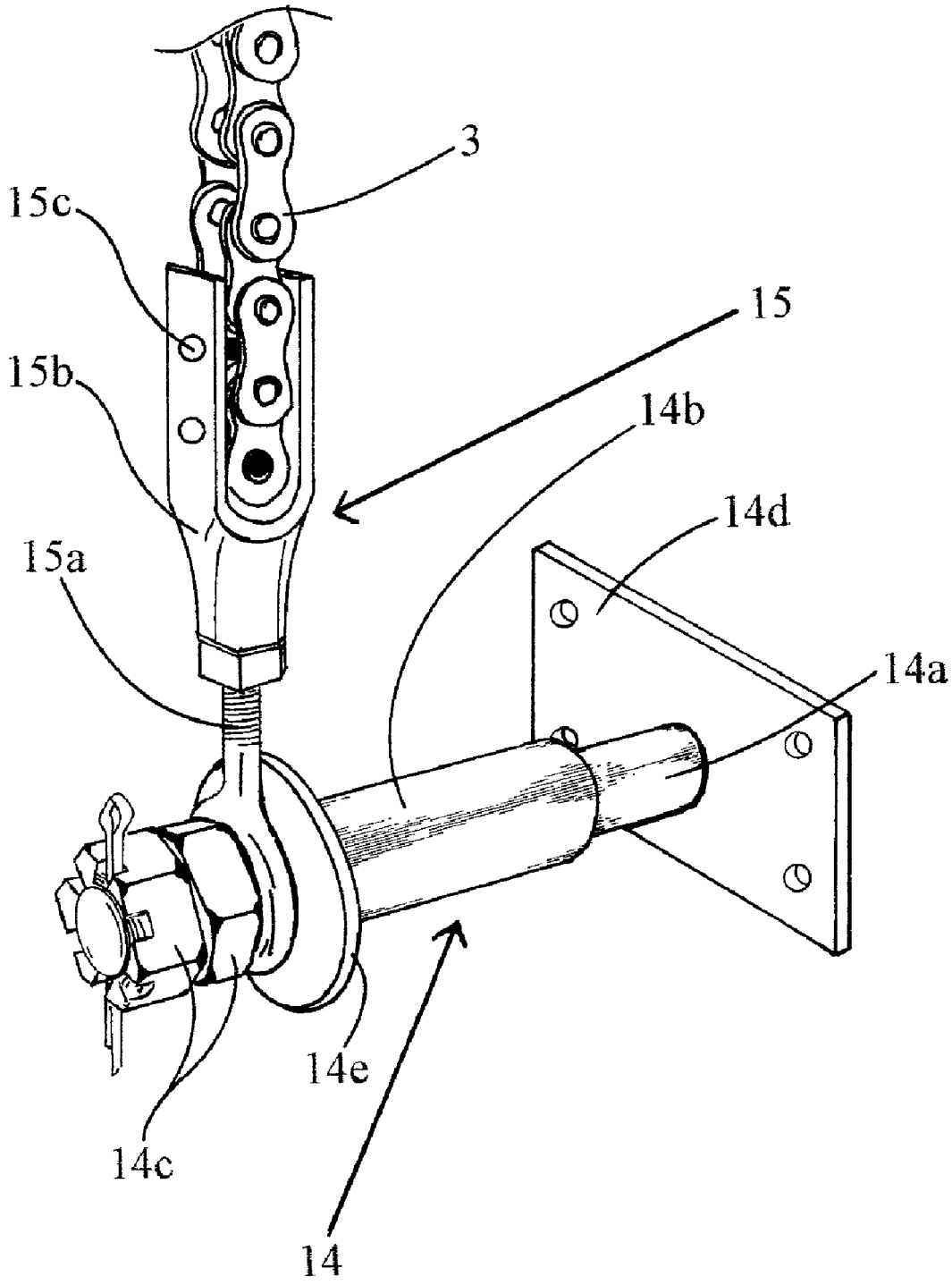
Figure 16:
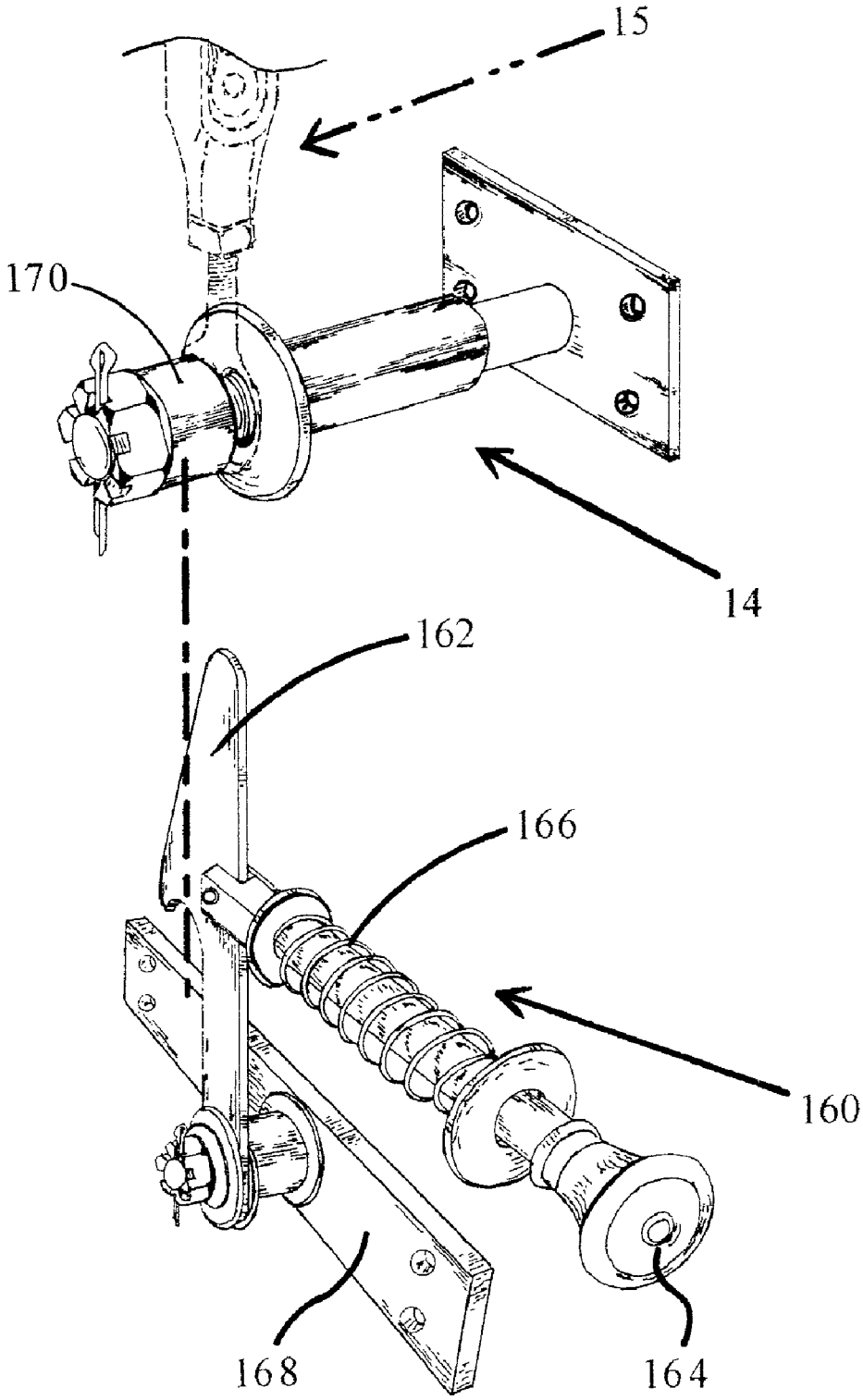

FIG. 9*a* is a side view of the portion 9*a* of the balanced movement system of FIG. 9;

FIG. 9*b* is a rear view of the portion 9*b* of the balanced movement system of FIG. 9 (that portion 9*b* is also referenced in FIG. 13);

FIG. 10 is an exploded partial three dimensional view of certain structural support and furniture components of a bed system, with the alternative type of timing device, according to the principles of the present invention;

FIG. 10*a* is a fragmentary, exploded illustration of portions of the timing components of the bed system, according to the principles of the present invention;

FIG. 11 is an exploded, partial three dimensional view of certain of the mechanical and furniture components of a bed system, with the alternative timing device, according to the principles of the present invention;

FIG. 12 is a three dimensional illustration of a bed system, with the alternative timing device, according to the principles of the present invention, with a corner portion cut away;

FIG. 13 is a rear view of the bed system of FIG. 12;

FIG. 14 is a front view of the leveler structure and bed platform bracket in a bed system according to the principles of the present invention;

FIG. 15 is a three dimensional view of the leveler structure and bed platform bracket in a bed system according to the principles of the present invention; and FIG. 16 is an exploded, three dimensional view of the latch mechanism in a bed system according to the principles of the present invention.

Exhibits A-H are photographs of a bed system constructed according to the principles of the present invention.

DETAILED DESCRIPTION

As discussed above, the present invention relates primarily to a new and useful bed system and method, that is designed to improve the aesthetics of the bed system, the ease and efficiency of raising and lowering the bed system manually, and the efficient use of the space in which the bed system is located. The principles of the invention are described and shown herein in connection with an embodiment of the present invention that can best be implemented with wooden furniture components. However, from the description, the manner in which the principles of the present invention can be implemented with other forms of furniture components (e.g. metal furniture components) will be apparent to those in the art.

Additionally, before describing the details of the bed system and method, it is believed useful initially to note that the bed system of the present invention can be designed as a free standing system that uses the entire space of the bed system's footprint to produce a bed, as well as a furniture/storage system. The bed is designed to be raised or lowered with minimal effort, by a balanced movement system located in the free standing furniture that forms part of the bed system, without detracting from the aesthetics of the bed system, and without using motors or other motive means. Counterweights, chains that are connected with the counterweights, and their support structure, are located in columns at the corners of the bed and top bridges at the head and foot sides of the bed, and are designed such that once the bed has been manually raised or lowered beyond a certain point the counterweights and the counterweight chains produce a motive force that assists in raising or lowering the bed to its desired height, and also maintains the bed in a raised or lowered position. Thus, relatively minimal effort is required to raise or lower the bed. When the bed is in a raised position, the bed effectively forms an alcove, so that supplemental furniture (e.g. desk, dresser, cabinet, dinette, sofa, etc) can be located below the bed, and the bottom of the bed forms a ceiling for the alcove. The system can be configured to form "windows" at the head and foot of the bed, that form part of the furniture alcove when the bed is raised, and which also provide an aesthetic aspect to the bed system when the bed is lowered as well.

Initially, it is believed useful to provide some definitions of terms that are used in this application, in connection with the present invention.

"Bed" means a bed platform that is raised and lowered by a balanced movement system, according to the principles of the present invention, and under-mattress flat balance weights that may be added to the platform, and used for equalizing the BMS.

"Bed Platform Plus" (BP+) refers to the bed platform, mattress, bedding, and the under-mattress flat balance weights (used for equalizing the BMS)

"Balanced Movement System" (BMS) refers to all the mechanical/utility components that raise and lower the bed BP+ to the stowed-away/raised position and lowered/sleep position.

"Bed System" refers to the BP+, the Balanced Movement System (BMS) and the furniture in which the BMS is housed.

Reference to counterweight system components being "substantially housed" or "substantially located" in furniture components means that the counterweight system components are basically covered by the furniture components (so that the furniture components can provide the bed system with an aesthetically pleasing appearance), but there may be small connection pieces that necessarily extend out of the furniture components to make connection between the counterweight system components and the bed, without detracting to any appreciable extent with the aesthetics of the system.

A bed system 100 (FIGS. 6-8), according to the principles of the present invention, comprises a bed platform 1 that forms part of the BP+, and a balanced movement system (BMS), that is shown and described in connection with FIGS. 1-5, for raising and lowering the BP+. The balanced movement system comprises a counterweight system that includes counterweights 4, counterweight chains 3, counterweight sprockets 5, and support structure, and is coupled with a bed platform 1 that forms part of the BP+. The counterweight system has a configuration such that the BP+ can be raised or lowered by application of manual force to the bed platform 1 in a selected direction, and a weight differential is created that initially maintains the BP+ in its raised or lowered position, and also facilitates movement of the bed platform 1 (and the BP+) in the selected direction. Moreover, when application of the manual force ceases, the BMS enables the bed platform 1 (and the BP+) to come to a stop, and to remain in a stationary position anywhere along it's vertical travel.

The counterweight system is designed so that the mass of the counterweights 4 is about equal to the mass of the BP+, so that the counterweights 4 act on the bed platform 1 with equal weight, and the counterweight chains 3 create the weight differential that initially maintains the BP+ in a raised or lowered position, and facilitates movement of the bed platform 1 (and the BP+) in the selected direction when manual force is applied to the bed platform in the selected direction.

The BMS also includes a timing structure connected with the counterweight system. One version of the timing structure is shown in FIGS. 1-5, and another version of the timing structure is shown in FIGS. 9-13. The timing structure (both versions) is configured to cause simultaneous movement of all of the counterweights 4 and the counterweight chains 3 in a manner such that all four corners of the bed platform 1 (and the BP+) must move simultaneously and in the same direction when manual force is applied to the bed platform 1 in a selected direction. In addition, the bed system may include under the mattress balance weights 7 (that can be selectively added to the bed platform 1), to provide a weight balance to the BP+ (i.e. the weights 7 are used to cause the BP+ to be weight balanced with the counterweights 4). In addition, a leveler 15, described more fully below, allows fine adjustment of the level of the bed platform 1 (and BP+) to make sure the bed platform 1 is level despite any sight misalignments of the counterweight chains 3 (e.g. misalignments that might occur if sprockets 5 are not perfectly aligned) that could initially cause the bed platform 1 to be other than level. Once the level of the bed has been established, the BMS is designed to maintain that level orientation of the bed platform and the BP+ during all of its subsequent movements, and also when the BP+ is in a stationary position. Moreover, on account of the leveler 15, the BP+ will remain level as the bed is raised and lowered, regardless of where an operator applies force to the BP+ to raise and lower it.

The counterweight system preferably comprises four counterweights 4, connected respectively to the four corner points of the bed platform 1 by the counterweight chains 3, the bed platform brackets 14 and the levelers 15. Furniture components are provided as ornamental features of the bed system, and the counterweights 4, the sprockets 5 (and rotatable shafts 8 and support structure for the shafts 8) and the counterweight chains 3 (and the leveler structure described below) are substantially housed inside the furniture components. Thus, as seen from FIGS. 6-8, the furniture components may include, e.g., cabinets 110 (and/or other furniture components) at the bottom of the bed system, substantially hollow vertical columns 112 that rest on and extend upward from the cabinets 110, head and foot board cross members 114 that rest on and extend across the tops of respective pairs of columns 112, and a channel 116 extending between the cross members 114 at the back of the bed system. In addition, windows 117 are formed between the columns 112, the cabinets 110 and the cross members 114, and trim 118 can be added to the cross members 114, all of which can enhance the aesthetics of the bed system. The bed platform brackets 14 that are connected with the four corners of the bed platform 1 extend through vertical slots 124 in the hollow vertical columns 112.

In the version of the bed system shown in FIGS. 1-5, the timing structure comprises a pair of timing devices (e.g. timing sprockets 10) connected to respective shafts 8 and to each other (e.g. via a timing chain 11 that extends through a timing chain bypass block 13) in a manner such that the shafts 8 that support the counterweight sprockets 5 are constrained to rotate in opposite directions and with the same angular velocity whenever a manual force is applied to the bed platform 1 in a selected direction. In the illustrated embodiment, the timing chain bypass block 13 forms a guide for the timing chain 11, to produce a figure eight chain configuration that causes the timing sprockets 10 (which are the same size) to always rotate in opposite directions and with the same angular velocity. Thus, the counterweight chains 3 connected to the four corners of the bed platform 1 should all move together, in the same directions and with the same angular velocity. A pair of tension sprockets 12 is provided to apply and maintain tension in the timing chain 11.

FIGS. 9-13 show an alternative form of timing device for the bed system. In FIGS. 9-13, components that are the same as the version shown in FIGS. 1-5 have the same numbers as the components of FIGS. 1-5. In the alternative version of timing device of FIGS. 9-13, a right angle gearbox 200 is coupled to each shaft 8 (and is supported on a frame part 206 shown in FIGS. 10, 10*a* and 11), and a rotatable connecting shaft 202 extends out of, and between the two right angle gearboxes 200. A pair of lock collars 204 each installed between and up against the right angle gearboxes 200 maintains the placement of and prevents horizontal movement of the rotatable connecting shaft 202. The rotatable connecting shaft 202 and the right angle gearboxes 200 have mating keys and keyways that engage the gears within the right angle gearboxes 200 in such a manner that rotation of the rotatable shafts 8 is always in opposite directions and with the same angular velocity. Thus, as with the previous version, the counterweight chains 3 and the counterweights 4 will all move in the same direction and with the same angular velocity as the BP+ is being raised or lowered.

The counterweight system is substantially disposed within the furniture components that include (i) the two pairs of substantially hollow columns 112, (ii) the headboard and footboard cross members 114 that extend between respective pairs of the substantially hollow columns 112, and (iii) the channel 116 that extends between the cross members 114. The furniture pieces at the bottom of the columns, e.g. the cabinets 110, enable the columns to rest on those furniture pieces, or if there are no such furniture pieces the columns can rest on the floor. In any such case, the vertical columns 112 rest on a support surface (e.g. furniture pieces such as cabinets 110, or the floor), so that the bed system is essentially free standing.

In the version shown in FIGS. 1-5, the rotatable shafts 8 upon which the counterweight sprockets 5 and timing sprockets 10 are mounted, are supported by respective support frames 130, each of which is located inside one of the hollow cross members 114. Each support frame 130 is formed by longitudinal side pieces 132 and cross pieces 134 that are fixed (e.g. by welding) to the side pieces 132. The shaft 8 is supported by the bearings 9 (which allow for smooth rotation), which are fixed (e.g. welded or bolted) to the cross pieces 134 in alignment with their respective openings 135 through which the shaft 8 extends. At the back end of the support frame 130, the shaft 8 extends out of the support frame 130 (i.e. beyond the cross piece 134 at the end of the support frame 130) and is connected to the timing sprocket 10. In the version with the alternative timing device (FIGS. 9-13) the right angle gearboxes 200 are located partially outside the support frames 130, and each shaft 8 extends out of the of the support frame 130 where it is connected to a respective right angle gearbox 200.

Figure 7:
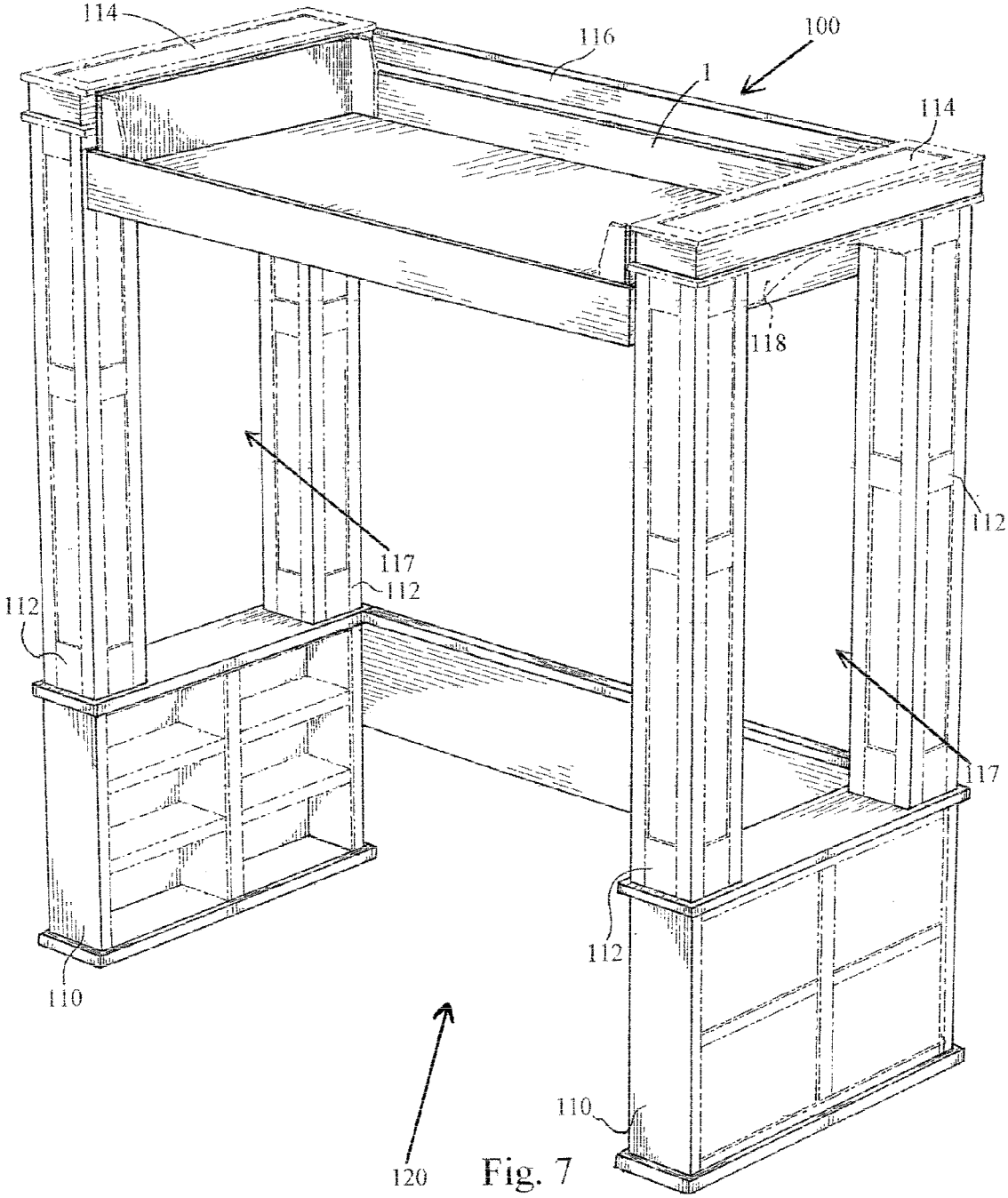
FIG. 7 is a three dimensional view of a bed system and method, according to the principles of the present invention, taken from an upper right perspective, with the bed in its raised position, and with certain furniture features of the bed system, that can be modified according to the present invention, shown in phantom.
Figure 8:
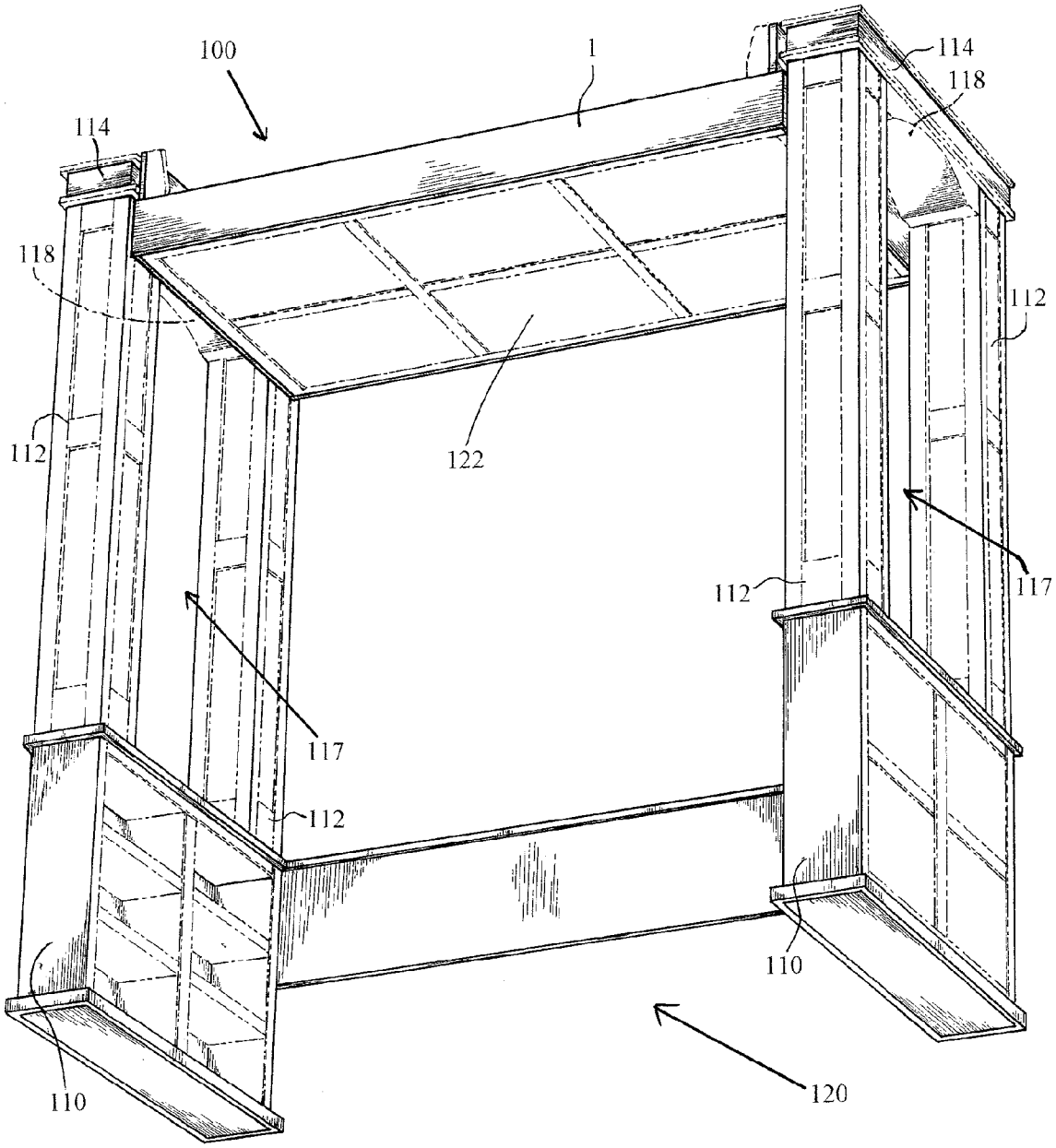
FIG. 8 is a three dimensional view of a bed system and method, according to the principles of the present invention, taken from a lower right perspective, with the bed in its raised position, and with certain furniture features of the bed system, that can be modified according to the present invention, shown in phantom.

The bed system has a raised position in which the bed platform 1 and the furniture components form an alcove beneath the bed platform 1, and wherein the bottom of the bed platform 1 defines a ceiling of the alcove. FIGS. 7 and 8 show the bed system in its raised position with the alcove 120 formed beneath the bed platform 1, and the bottom of the bed platform 1 effectively forming a ceiling 122 of the alcove (see FIG. 8).

In assembling a bed system according to the present invention, a pair of modular components are preformed and used in the installation. Each modular component includes a support frame 130, a set of bearings 9, a shaft 8 extending through the bearings that are in alignment with the openings 135 in the cross pieces 134 of the frame, with a pair of counterweight sprockets 5 and may optionally include the timing sprocket 10 or a right angle gearbox 200 connected with the shaft 8 (i.e. the timing sprocket 10 or right angle gearbox 200 can be preassembled with the shaft 8, or can be assembled to the shaft 8 as the bed system is being installed, in which case the modular component would be the bearings 9, counterweight sprockets 5 and the shaft 8 with a portion extending out of the support frame 130 and configured for assembly with a timing sprocket 10 or right angle gearbox 200). The shaft 8 and each of the counterweight sprockets 5 and timing sprocket 10 or right angle gearbox 200 have mating keys and keyways that enable the sprockets (5, 10), or right angle gearbox 200 to be properly aligned along the shaft 8. Bearings 9 that are fixed (e.g. welded or bolted) to cross pieces 134 provide bearing support for the shaft 8. In addition, hex screws 136 are provided to tighten the bearings 9 to the shaft 8 (thus maintaining the horizontal placement of the shaft 8), and the sprockets (5, 10) to the shaft 8. Still further, a cotter pin 138 is used to ensure the sprocket 10 maintains proper position on the shaft 8. In the version using the right angle gearbox 200, the right angle gearbox is bolted to the frame piece 206, thus maintaining its proper position on the shaft 8.

At a site where the bed system is being installed, the modular component (i.e. the support frame 130, the bearings 9, the shaft 8 that is rotatably supported from the support frame 130, and sprockets 5, [and optionally the timing sprocket 10, or the right angle gearbox 200] that are connected with the shaft 8) is installed inside the hollow furniture cross members 114. With the wooden furniture components of the system, as shown, e.g. in FIGS. 3, 6-8, and 11, the furniture components forming the cross members 114 would open at the top, so that the modular component formed by the support frame 130, the shaft 8, bearings 9 and sprockets 5, would be dropped into the furniture component. Then, the counterweight chains 3 would be wound on the sprockets 5, and the counterweights 4 dropped into the columns 112 (and later the top of the furniture component can be closed to complete the furniture cross member 114). Alternatively, the support frame 130 of the modular component can be laid across and fixed (e.g. welded or bolted) to the columns 112, the counterweight chains 3 can be wound on the sprockets 5 and the counterweights 4 dropped into the hollow columns 112, and any trim that would complete the furniture would then be connected directly to the support frame 130. The counterweight sprockets 5 are located along the shaft 8 such that each counterweight chain 3 and its counterweight 4 will extend into a respective hollow column 112. The cross channel 116 which contains a chain bypass block 13 within and has "cut outs" to fit around the timing sprockets 10 (or the right angle gearboxes 200) is then installed (e.g. by means of bolts) to the rear ends of the frames 130, effectively connecting the headboard and footboard sides of the furniture and BMS and closes off the ends of the hollow cross members 114. The timing chain 11 is then wound around the timing sprockets 10, across the tensioning sprockets 12 and through the chain bypass block 13 in a manner which creates a "figure eight", then connects to itself using a standard connecting link to effectively form an endless loop. The tensioning sprockets 12 would be then tightened against the timing chain 11 to create proper tension. In the version using the alternative timing device (FIG. 9-13), the rotatable connecting shaft 202 with the lock collars 204 attached would be inserted into the right angle gearboxes 200 (which are mounted on the modular component frames 130 and connected to rotatable shafts 8) and centered, then the lock collars would be slid into position up against the right angle gearboxes 200 and tightened onto the rotatable connecting shaft 202 to maintain proper shaft 202 placement. Decorative trim is installed to the exterior of the cross channel 116 which effectively encloses the timing mechanism within and maintains the aesthetics of the furniture.

The levelers 15 are used to provide a fine adjustment for leveling the bed platform 1 (and the BP+) can be appreciated from FIGS. 14, 15. At each corner of the bed platform 1, a bed platform bracket 14 is provided. The bed platform bracket 14 includes a mounting plate **14*d* that is fixed to the bed platform 1, a pin 14*a* that is welded or otherwise fixed to the mounting plate 14*d* extends away from the bed platform 1 and into the hollow column 112 (through a vertical slot 124 in the column). A leveler 15 has a threaded stem 15*a* with an eyelet (also labeled 15*a*) through which the pin 14*a* extends. The threaded stem 15*a* fits into a threaded mating opening in a leveler portion 15*b* that is connected to the chain 3. The leveler portion 15*b* is fixed to the links of counterweight chain 3 by means of pins 15*c* that extend through links of the counterweight chain 3 and are welded or otherwise fixed to the leveler 15*b*. A sleeve 14*b* surrounds the pin 14*a*, and a nylon washer 14*e* is disposed between the sleeve 14*b* and the eyelet 15*a*. Lock nuts 14*c* hold the leveler structure in its proper placement. Also, on one of the four bed platform brackets 14 (corresponding to the corner in which the latch mechanism 160 is installed) a round bushing 170 (FIG. 16) takes the place of the inner lock nut 14***c* in a manner that leaves the bushing 170 loose enough to rotate on the pin 14*a* and against the latch member 162 (which is installed in vertical alignment to the bushing 170) when the bed platform 1 is lowered into its lower resting position, thereby actuating the latch mechanism 160. The nylon washers 14*e* interact with the walls of the hollow columns 112 interior to prevent sidewise shifting of the bed platform, and maintain proper spacing between the bed platform 1 and the columns 112. The sleeve 14*b* is shaped so that it (and the pin 14*a* inside the sleeve 14*b*) will be guided vertically in a respective slot 124 in the column 112, and the sleeve 14*b* is formed of a material that allows the sleeve 14*b* to rotate on the pin 14*a* to allow the sleeve/pin to be guided accurately by the slot 124, while minimizing the effect of contact between the slot 124 and the sleeve 14*b* as the bed platform is being moved along the vertical column 112. With the levelers 15, each corner of the bed platform can be finely adjusted by turning the threaded eyelet stem 15*a* in the leveler portion 15*b* clockwise or counter clockwise, to bring the bed platform 1 and the BP+ to a level condition. Once the BP+ is leveled in this manner, it will remain level, regardless of where force is applied to the BP+ to raise or lower the BP+. The foregoing levelers 15 allow fine adjustment of the corners of the bed platform, to level the bed platform while accounting for any slight inconsistencies in sprocket teeth alignments at the time of the installation.

As the BP+ is being assembled, there may be some weight imbalances that could affect operation of the bed system (i.e. the BP+ should ideally be weight balanced to the counterweights 4). To minimize such weight imbalances, the under the mattress balance weights 7 can be selectively installed on the bed platform 1, in any desired locations and with any desired weight allocation.

In order to raise and lower the BP+ all that is required is relatively small application of manual force in one direction, to initiate the movement. It should be noted that if manual force is discontinued during movement of the BP+ toward either of its raised or lowered positions, the BP+ will come to a stop. Specifically, the BP+ and the counterweights 4 will apply some downward force (due to their weight) to the sprockets 5, and thereby to the shaft 8, and create friction (and/or some slight binding) between the shaft 8 and the bearings 9 plus the natural friction created by chains 3, 11 and sprockets 5, 10 moving upon each other. Upon movement of the BP+, when force is removed, the friction overcomes any weight differential of the counterweight chains 3 and causes the BP+ to come to a stop, regardless of position along its vertical travel. When the BP+ is at rest in any position throughout vertical travel, the weight distribution of the counterweights 4 and their counterweight chains 3 is closely balanced, and maintains (due to balance and friction) the BP+ at rest in that position. Therefore, relatively small amount of manual force will upset the balanced weight distribution and initiate movement in a desired direction. When the BP+ is in its lowered position, the BMS is in the orientation of FIG. 1, the weight of the counterweights 4 are substantially equal to the weight of the BP+, the weight of the counterweight chains 3 (which is a relatively modest six pounds or so) is on the bed platform 1 side of the counterweight sprockets 5, so when the BP+ is in the lowered position of FIG. 6, the counterweight chains 3 produces about a six pound weight differential which is effectively added to the BP+, and tends to keep the BP+ in its lowered position. Thus, to initiate movement to raise the BP+ all that is required is a manual force that overcomes the six pound weight differential and the friction. As soon as that movement is initiated, the counterweights 4 move downward, the counterweight chains 3 move in a manner that reduces the weight differential, thereby making it easier to move the BP+ toward its raised position. As the BP+ continues to move upwardly, the BMS reaches a condition where the weight distribution is equalized (i.e. there are equal lengths of the counterweight chains 3 on the counterweight 4 and BP+ sides of the sprockets 5), then with continued upward movement the weight differential of the counterweight chains 3 becomes greater on the counterweight 4 sides of the sprockets 5 and assists the upward movement of the BP+. When the BP+ is at or near its raised position, and the manual force is released, the weight differential of the counterweight chains 3 is fully on the counterweight 4 sides of the sprockets 5; i.e. the same six pound weight differential that was created when the BP+ was in its lowered position is now on the counterweight sides of the sprockets and will maintain the BP+ (which now effectively weighs less) in a raised position.

When manual force is applied to lower the BP+ all that is required to initiate that movement is a force that overcomes the six pound weight differential and friction that now maintains the BP+ in the raised position. As the BP+ is moved downwardly toward its lowered position, the weight differential progressively reduces, and after the weight differential has been neutralized, continued downward movement of the BP+ is assisted by the weight differential. When the BP+ has reached its lowered position, the weight differential maintains the BP+ in its lowered position. In addition, when the BP+ has reached its lowered position, its weight is transmitted to the furniture (e.g. cabinet 110) that is easily capable of supporting the six pound weight differential of the counterweight chain 3, and is also capable of transferring to the floor the additional weight of a person resting on the BP+).

The bed system preferably has a latch mechanism 160 (shown in FIGS. 1, 9, and in detail in FIG. 16), that can be mounted at any one or more of the corners of the bed system, which is automatically engaged when the bed platform is lowered into its lowered/sleep position, and provides an additional useful function to the bed system. A latch mounting bracket 168 mounts to the inside of a column and pivotally supports a latch member 162. The latch member 162 is biased (by a spring 166) toward a position shown in FIG. 16 where its angled top side is located in the path of the bushing 170 (that is installed on the pin 14*a* of the bed platform bracket 14) as the bed system moves into its lowered position. The configuration of the top side of the latch member 162 enables the latch member to be engaged by the bushing 170 and forced against the bias of spring 166 (which is located on a release lever and knob 164, and is compressed against an inside wall of a hollow column 112 to create the springs' resistance) until the bushing 170 clears the hooked shaped bottom of the latch member 162. Then, the spring 166 returns the locking member to a position that it will restrain upward movement of the bed platform until the latch member 162 is released by pulling the release knob 164 (which extends out from within the hollow column 112). When upward force is applied to the bed platform 1 (in its lowered, latched position) the latch mechanism 160 cannot be released (due to the bushing 170, [which is being held centered in the hook shaped latch member 162] requiring sufficient vertical clearance space to bypass the latch member 162 when the release knob 164 is pulled) until the upward force is discontinued which acts as an additional safety component. The latch mechanism 160, while not necessary to the proper operation of the bed system (because the BMS is designed to maintain the bed system in a lowered position), provides a useful function to the bed system, when the bed system is in its lowered position. Specifically, when the bed systems mattress or bedding is being changed, since the latch mechanism will be engaged, and maintain the BP+ in the lowered position, any risk posed by changing the mattress or bedding causing a weight imbalance that causes the bed system to move in an unintended fashion is eliminated.

As shown by Exhibits A-H, a bed system formed according to the principles of the present invention provides efficient use of room space, and provides an aesthetic look to a room in which the bed system is located.

Thus, the present invention provides a bed system comprising a bed, and a balanced movement system for raising and lowering the bed and for maintaining the bed in a stopped position when application of force to the bed is stopped. The balanced movement system is (i) configured to enable the bed to be raised or lowered by application of force to the bed in a selected direction, and (ii) configured such that when application of the force ceases the bed will come to a stopped position and be maintained in the stopped position by the balanced movement system, and applying force to the bed in a selected direction to raise or lower the bed.

Figure 1:
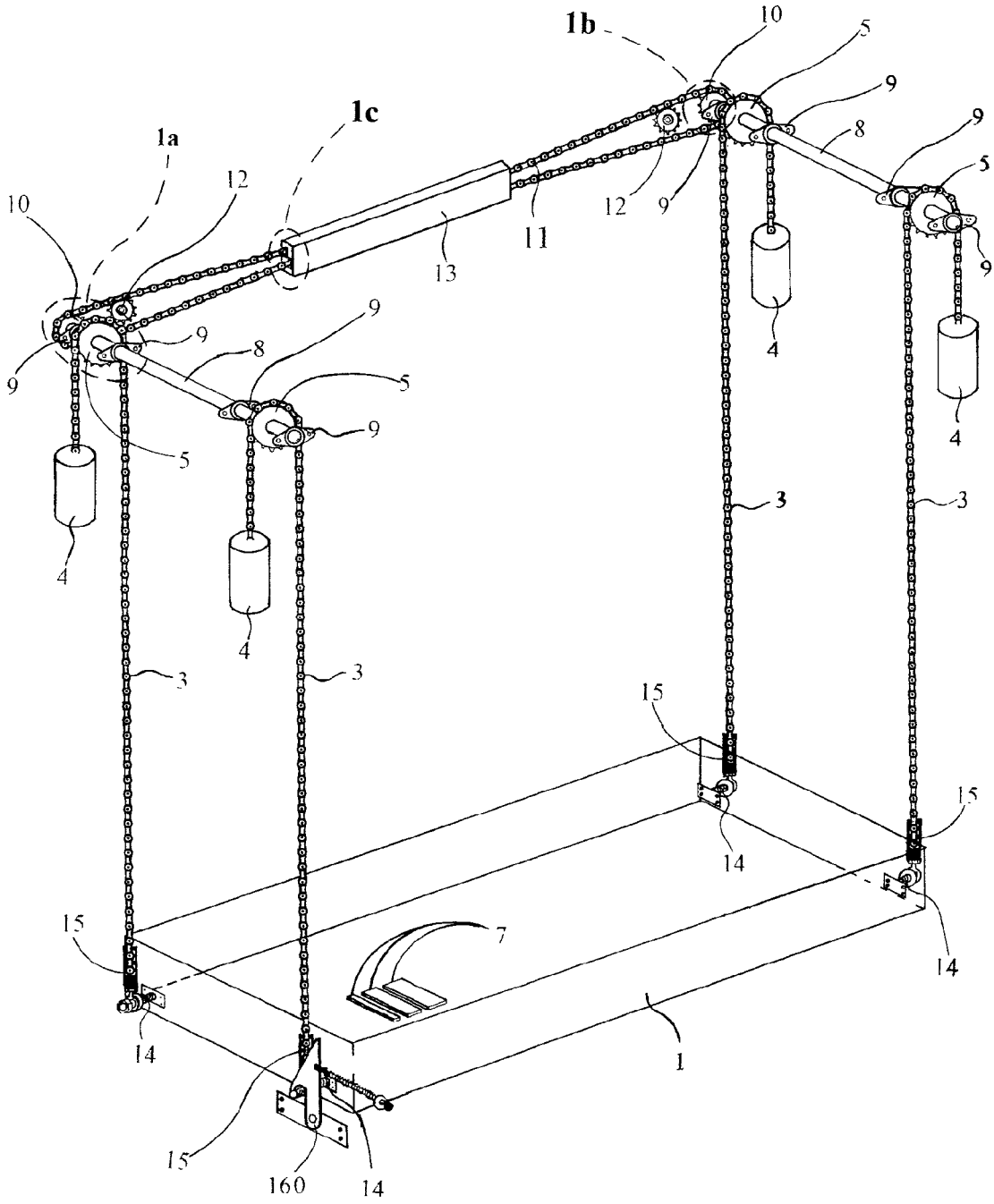
Figure 1A:
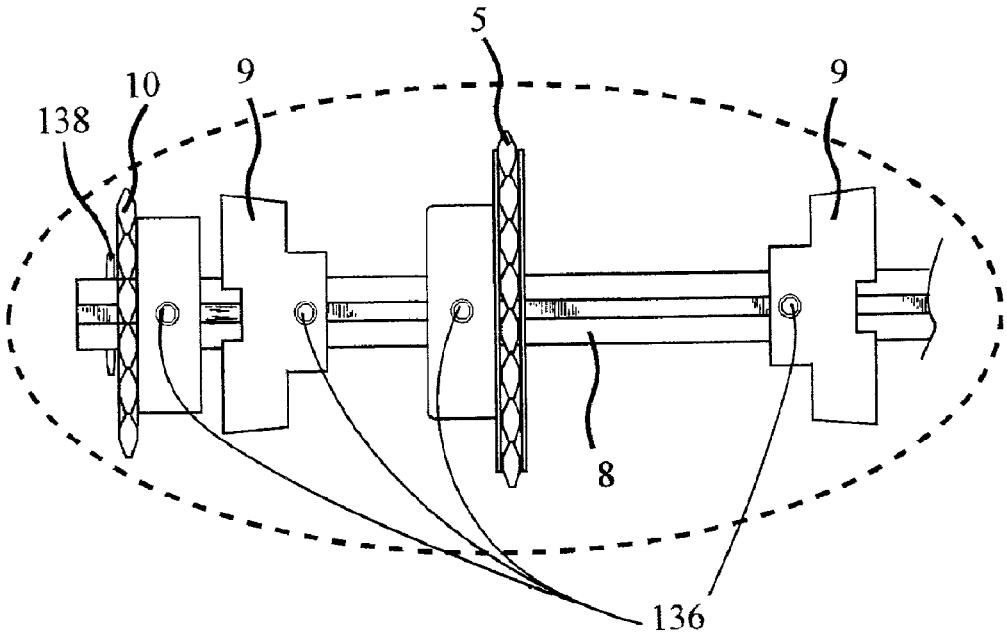
Figure 1B:
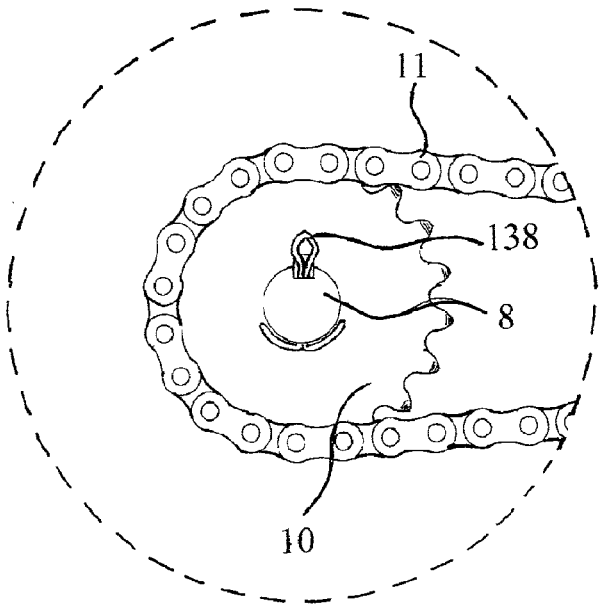
Figure 1C:
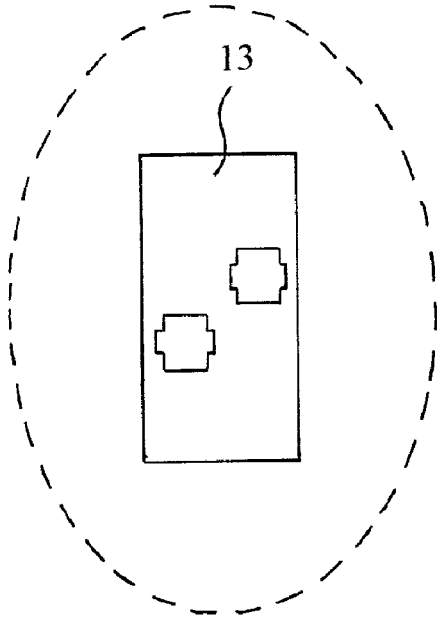
Figure 2:
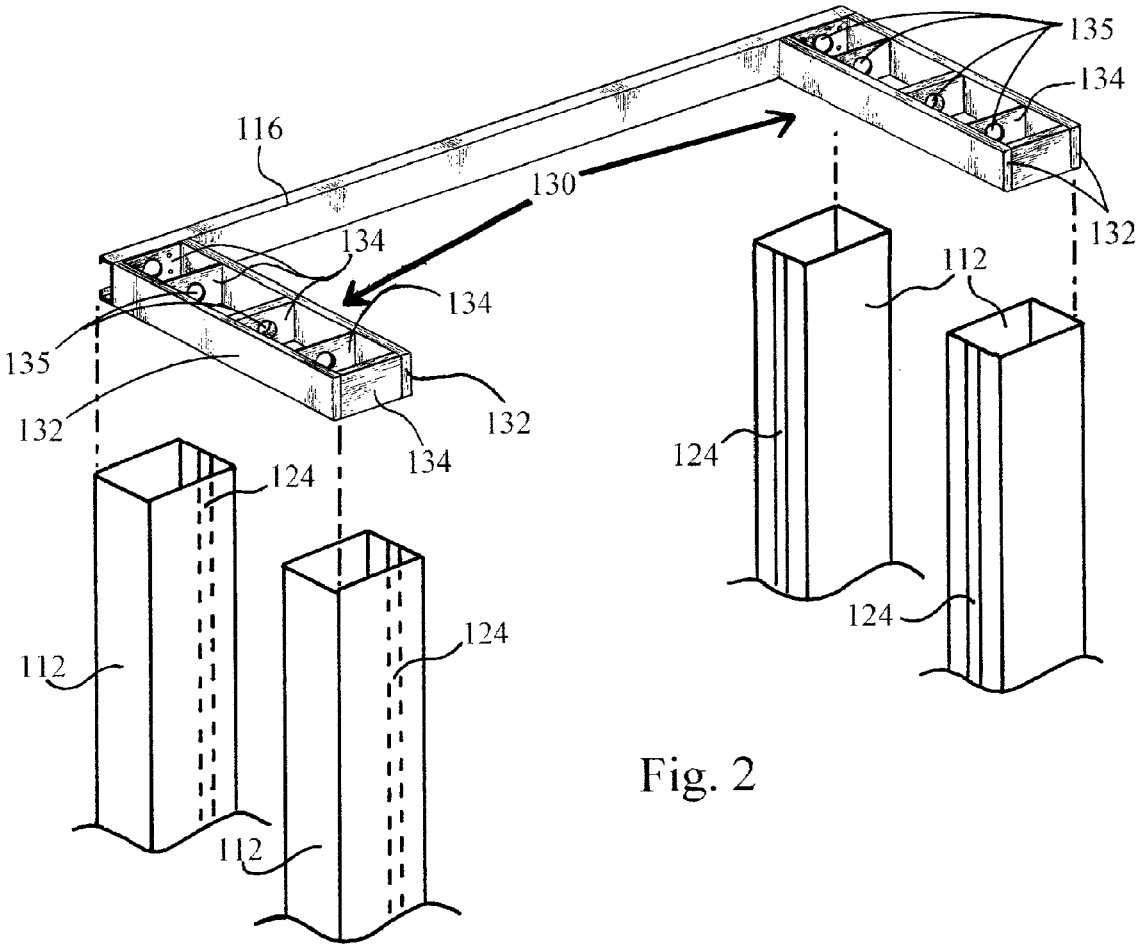
Figure 2A:
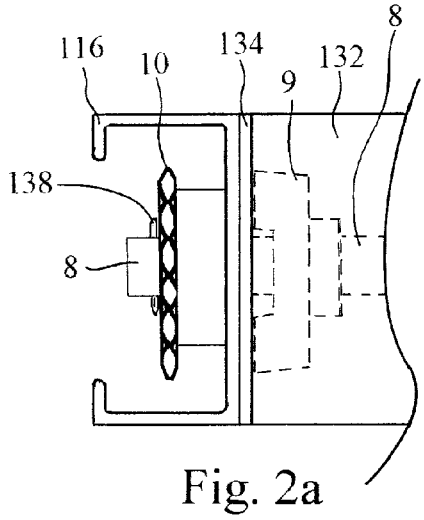
Figure 3:
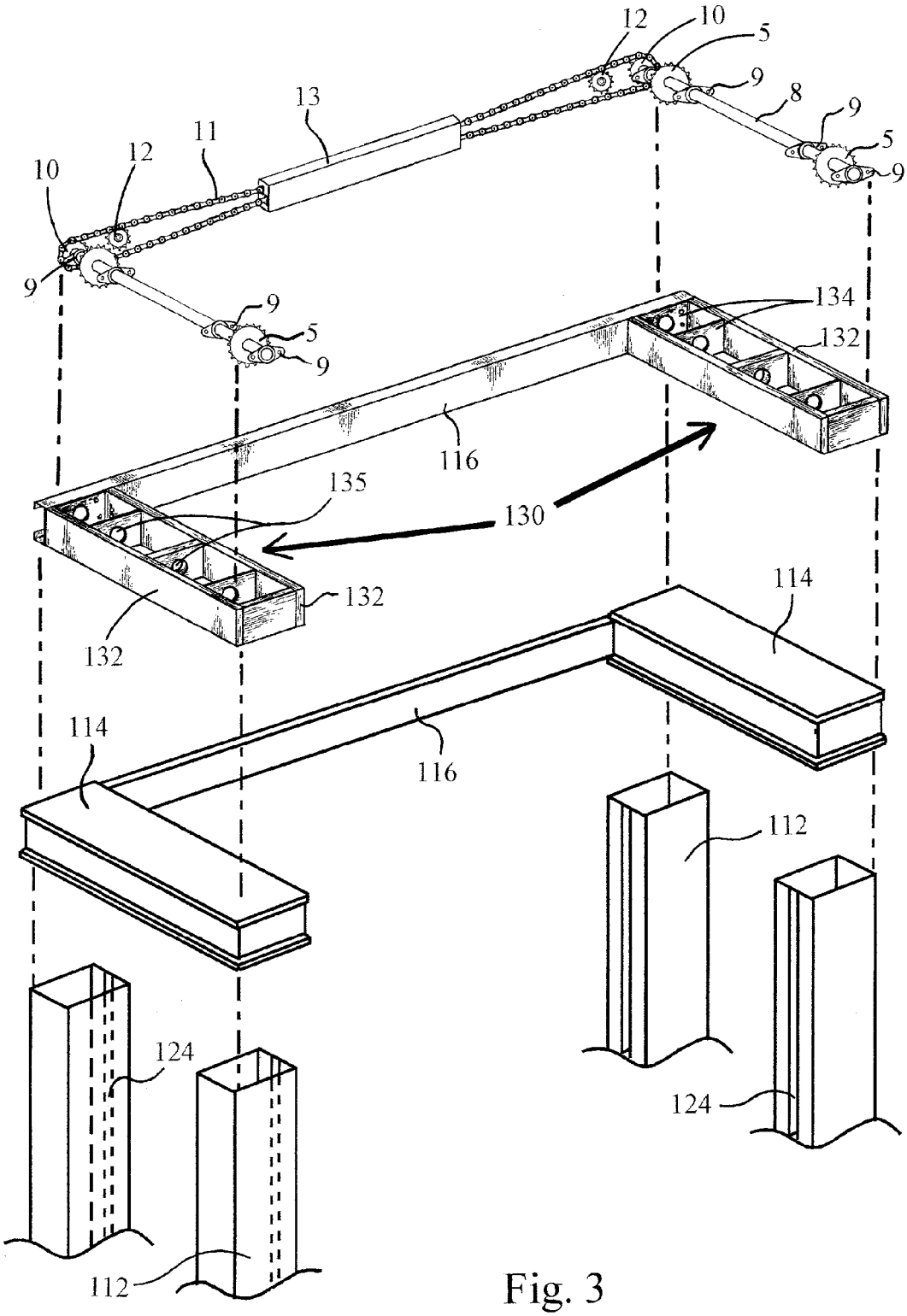
FIG. 3 is an exploded, partial three dimensional view of certain of the mechanical and furniture components of a bed system, according to the principles of the present invention.
Figure 4:
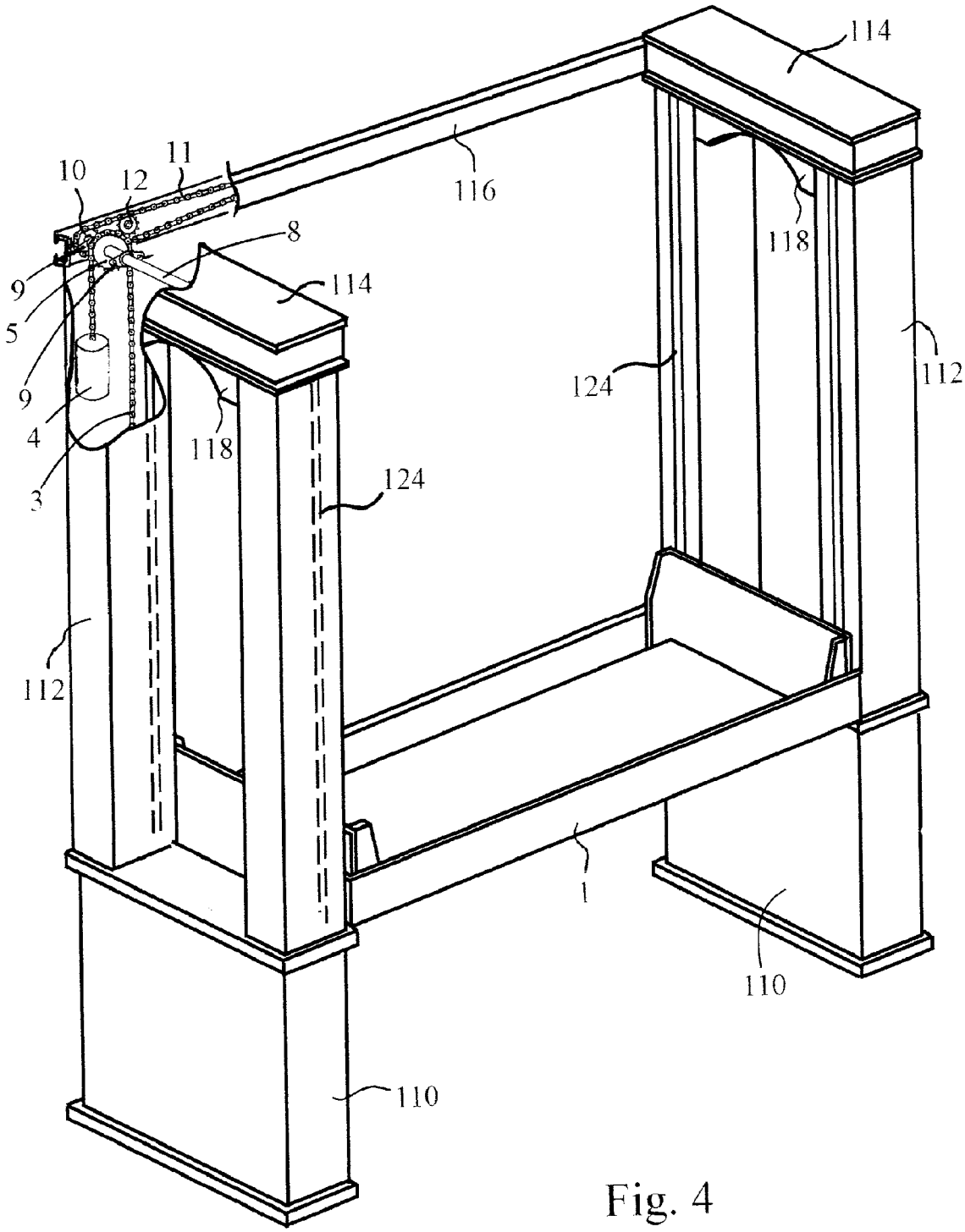
FIG. 4 is a three dimensional illustration of a bed system, according to the principles of the present invention, with a corner portion cut away.
Figure 5:
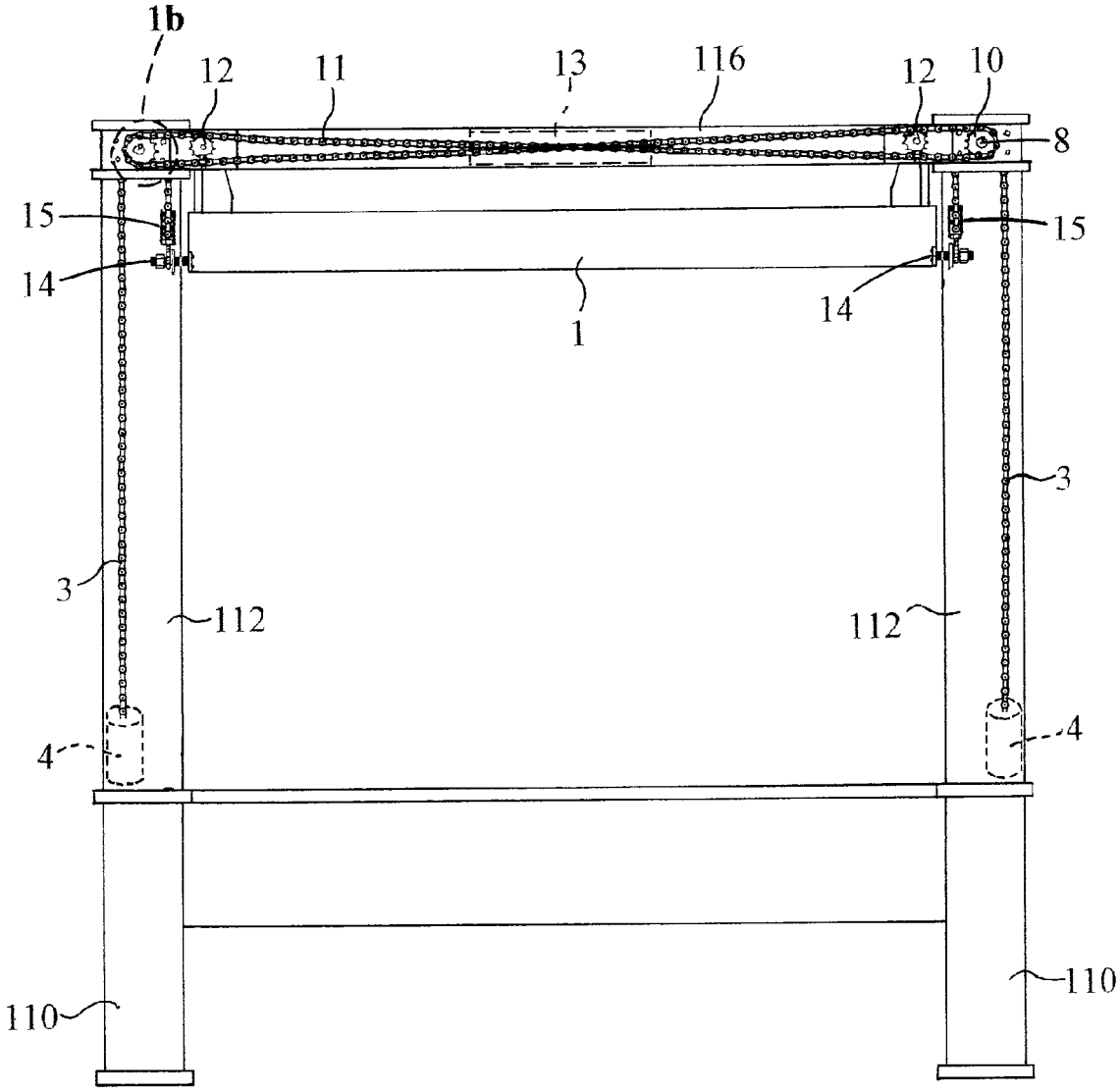
FIG. 5 is a rear view of the bed system of FIG. 4.
Figure 6:
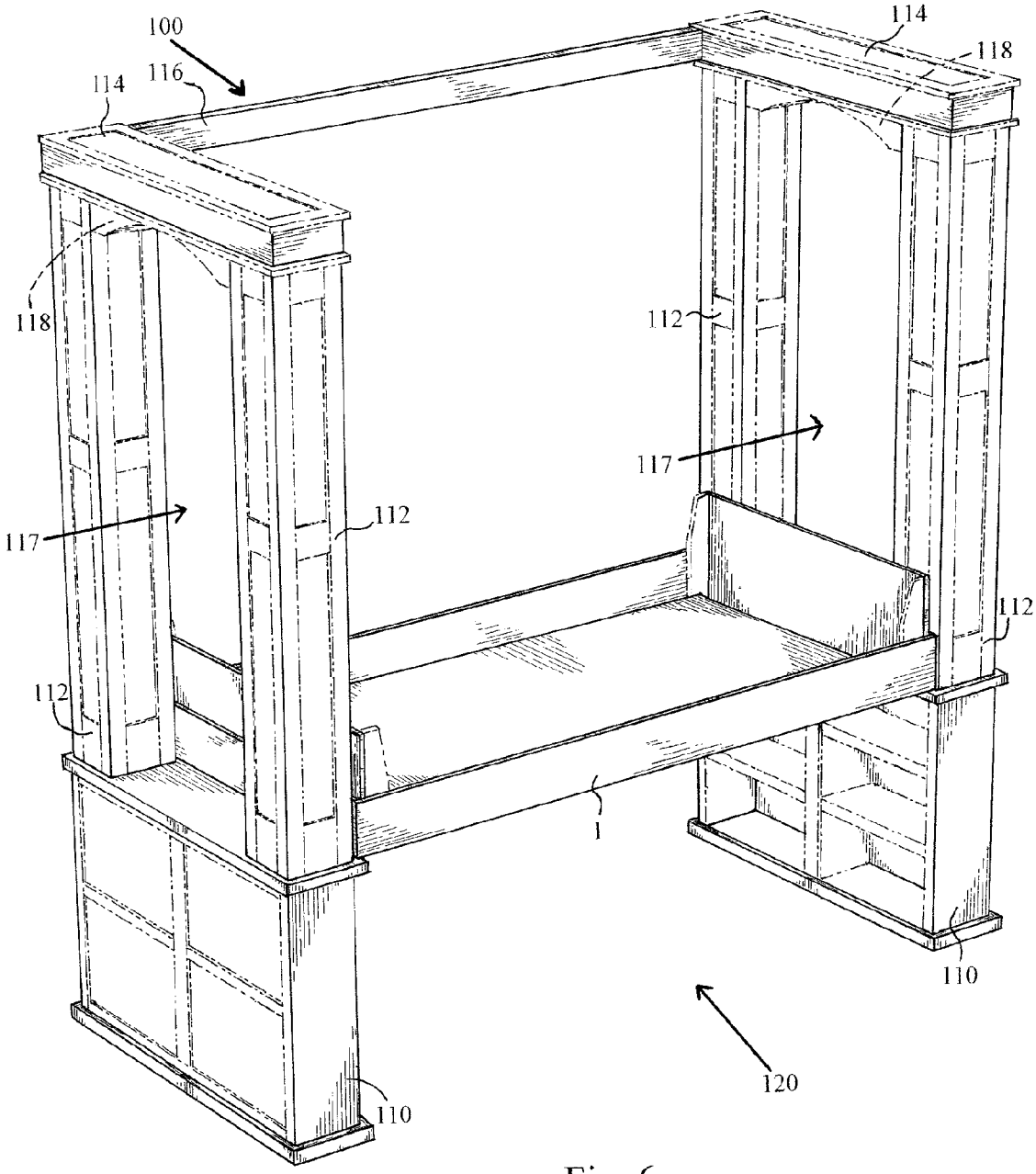
FIG. 6 is a three dimensional view of a bed system and method, according to the principles of the present invention, taken from an upper left perspective, with the bed in its lowered position, and with certain furniture features of the bed system, that can be modified according to the present invention, shown in phantom.

Further features of the system and method of the present invention are described below Balanced Movement System The BMS is a system of vertically moving the BP+ (which may include the bed platform 1, a mattress, bedding, and the under-mattress flat balance weights 7) from a raised/stowed-away position (FIGS. 7, 8) that forms the alcove 120 to a lowered/sleep position (FIG. 6).

The BMS utilizes the counterweight system that is housed in furniture that is comprised of the four columns 112 within which the four counterweights 4 act upon an equal weight (1:1 ratio) of the "Bed Platform Plus" (BP+). Vertical movement is achieved when minimal force is applied by the user.

The BMS is a unique system in which when the BP+ is raised, the decreased amount of chain on the BP+ side of the counterweight sprocket 5 compared with the increased amount of chain on the counterweight side of the counterweight sprocket 5 creates a weight differential that naturally keeps the bed platform 1 up with no additional latching necessary. The same (inverse) is true when the reverse action is performed (i.e. counterweights up, BP+ down).

Minimal applied force is needed to initiate movement of BP+ in either direction. When the force is removed at any point during vertical movement, the bed platform 1 and the BP+ simply comes to a stop.

Equal distribution of weight between BP+ and counterweights 4 at the four corner points of the bed platform 1 makes for smooth, even movement which is virtually silent, as no motors are needed to actuate movement, and components are completely enclosed within the bed system furniture.

When the BP+ is in the lowered/sleep position, it rests upon the lower section of the head and foot sides of the furniture (specifically, in the illustrated embodiment, it rests on the furniture such as the cabinets 110. All the weight is then directed to the floor through the furniture; the weight of the sleeper and the BP+ is held by the furniture components, not the BMS components.

The horizontal leveling aspect of the system is a unique, simple system of maintaining accurate, horizontal level movement throughout the vertical travel of the BP+.

You can apply force to any part of the BP+, in ascending or descending direction, and with minimal effort, the bed will move up or down and stay level.

With the BMS, especially the timing system, it is impossible to ever move the bed platform 1 out of level.

The system of the present invention has a number of user friendly aspects. Specifically, a. The bed system is designed to fit any standard sized innerspring mattress or the like.

b. It is designed to be simple and elegant to operate, needing only to be pulled down or pushed up with minimal force or effort to effect movement of BP+.

c. It is simple to set up and maintain the weight balance between BP+ and counterweights 4 by use of the under-mattress flat balance weights 7, which are provided to compensate for different weight mattresses and seasonal bedding needs or changes.

d. The bed system has no exposed moving parts except for the BP+ itself, and the pins 14*a* and sleeves 14*b* that extend through the slots in the vertical columns. The BMS is comprised of heavy duty components built to last a lifetime, with virtually no maintenance required except for roller chain 3, 11 lubrication (when needed, depending upon climate and humidity levels).

e. Bedding and mattress changes are made easy by the use of the latch mechanism 160, which holds the bed platform 1 in the lowered position to assist in these operations.

f. Depending on desired supplemental furniture in the alcove 112 area, the bed at lowered position is either at standard bed height, or a height which requires only a 16" stepstool for access. This eliminates the need for a ladder, and allows virtually anyone to use the bed.

g. This bed system is a benefit over loft-style and bunk beds for two reasons: (a) when the BP+ is in the raised position, it is higher than a loft or bunk-bed, leaving plenty of space for standing and for supplemental furniture in the alcove 120 area, and (b) when the BP+ is in the lowered/sleep position, no ladder is required, and there is an open, free space overhead (anti-claustrophobic).

h. The bed system is designed to be an elegant, free-standing, four column design piece of furniture that allows placement anywhere in a room and against almost any wall, including those with windows, as the sides are open between columns.

i. Shelving can also be built into the bed system (between head and foot side columns), making it so nearly all the area within the bed system's footprint can be utilized. Artwork, pictures, LCD monitors, or such items can be mounted on the wall in the spaces between the columns, thus maximizing the usable surface area.

j. The bed system creates an alcove 120, making the space below usable, and allowing for accommodation of various supplemental furniture configurations. Any supplemental furniture that fits within the height limit of the bed's lowered/sleep position need not be moved.

k. Custom made furniture column 112 heights and BMS chain 3 lengths allow for placement in any room, regardless of ceiling height.

l. The bed system is three sided (head, foot, and rear), with the front being open to the room in which it's installed (if installed against a wall), so when the bed is in the lowered position, it has open, unobstructed access, and an open feel. Moreover, when the bed is in the raised position, the alcove 120 formed by the bed system is open to the room, thereby making most of the bed systems space available to an occupant of the room.

m. The latch mechanism 160 is built into the bed system, so when the BP+ is in the lowered position, it automatically locks the BP+ into place, making bedding and mattress changes possible without the threat of the BP+ moving unintentionally. The BP+ cannot be raised until upward force is discontinued from the BP+ thus allowing the latch to be released, which acts as a safety component.

n. All components are heavy duty or industrial grade, rated at a multitude of times the given weight load. Since the weight is divided among four points, the weight load is further minimized.

With the foregoing disclosure in mind, it is believed that various adaptations of a bed system and method, according to the principles of the present invention, will be apparent to those in the art.

The invention claimed is:

1. A system for raising and lowering a bed comprising:

a bed platform;

a balanced movement system comprising a counterweight system and a coordinated timing structure, the counterweight system comprising a plurality of counterweights connected to and acting on the bed platform through a like plurality of counterweight chains, the counterweight chains connecting the counterweights and the bed platform by traversing a like plurality of counterweight sprockets located on at least two rotatable shafts, the counterweight chains having their own weight that creates a weight differential that opposes movement of the bed when force is applied to the bed to change its resting position, the timing structure comprising at least two timing sprockets and a timing chain, each timing sprocket located on one of the two rotatable shafts configured opposite each other, the timing chain being looped around both timing sprockets in a figure-eight arrangement thereby coordinating the movement of the two rotatable shafts such that they rotate in opposite directions at substantially the same angular velocity.

2. The system of claim 1 wherein the bed has four corners.

3. The system of claim 2 wherein each corner of the bed is connected to one counterweight through one counterweight chain, the chain traversing a dedicated counterweight sprocket.

4. The system of claim 1 wherein the weight differential is attributable to the amount of counterweight chain used.

5. The system of claim 1 wherein the weight of the bed platform, mattress and bed linens is substantially equal to the total counterweight exclusive of the chain's weight.

6. The system of claim 1 additionally comprising a bypass block for guiding the timing chain configured in a figure-eight, the bypass block having two separate tracks at the point where the chains would cross one another, the bypass block comprising a low-friction material such as a polymer.

7. The system of claim 1 further comprising at least one tension sprocket for adding tension to the timing chain.

8. The system of claim 1 additionally comprising mattress balance weights in or on the bed platform.

9. The system of claim 1 further comprising levelers at one or more corners, the levelers connected between the counterweight chain and the bed.

10. The system of claim 1 wherein the counterweight system is substantially disposed within furniture components that include (i) two pairs of substantially hollow columns, (ii) headboard and footboard cross members that extend between respective pairs of the substantially hollow columns, and (iii) a channel that extends between the pairs of substantially hollow columns; and wherein the two pairs of substantially hollow columns are configured to rest on a support surface, so that the bed system is essentially free standing.

11. A system for raising and lowering a bed comprising:

a bed platform;

a balanced movement system comprising a counterweight system and a coordinated timing structure, the counterweight system comprising a plurality of counterweights connected to and acting on the bed platform through a like plurality of counterweight chains, the counterweight chains connecting the counterweights and the bed platform by traversing a like plurality of counterweight sprockets located on at least two rotatable shafts, the counterweight chains having their own weight that creates a weight differential that opposes movement of the bed when force is applied to the bed to change its resting position, the timing structure comprising at least two right angle gearboxes and a rotatable connecting shaft, each right angle gearbox being connected to one of the at least two rotatable shafts configured opposite each other, the right angle gearboxes also being connected to the rotatable connecting shaft thereby coordinating the movement of the two rotatable shafts such that they rotate in opposite directions at substantially the same angular velocity.

12. The system of claim 11 wherein the bed has four corners.

13. The system of claim 12 wherein each corner of the bed is connected to one counterweight through one counterweight chain, the chain traversing a dedicated counterweight sprocket.

14. The system of claim 11 wherein the weight differential is attributable to the amount of counterweight chain used.

15. The system of claim 11 wherein the weight of the bed platform, mattress and bed linens is substantially equal to the total counterweight exclusive of the chain's weight.

16. The system of claim 11 additionally comprising mattress balance weights in or on the bed platform.

17. The system of claim 11 further comprising levelers at one or more corners, the levelers connected between the counterweight chain and the bed.

18. The system of claim 11 wherein the counterweight system is substantially disposed within furniture components that include (i) two pairs of substantially hollow columns, (ii) headboard and footboard cross members that extend between respective pairs of the substantially hollow columns, and (iii) a channel that extends between the pairs of substantially hollow columns; and wherein the two pairs of substantially hollow columns are configured to rest on a support surface, so that the bed system is essentially free standing.

19. A method of raising and lowering a bed, comprising:

providing a bed system comprising a bed platform and a balanced movement system, the balanced movement system comprising a counterweight system and a coordinated timing structure, the counterweight system comprising a plurality of counterweights connected to and acting on the bed platform through a like plurality of counterweight chains, the counterweight chains connecting the counterweights and the bed platform by traversing a like plurality of counterweight sprockets located on at least two rotatable shafts, the counterweight chains having their own weight that creates a weight differential that opposes movement of the bed when force is applied to the bed to change its resting position, the timing structure comprising at least two timing sprockets and a timing chain, each timing sprocket located on one of the two rotatable shafts configured opposite each other, the timing chain being looped around both timing sprockets in a figure eight arrangement thereby coordinating the movement of the two rotatable shafts such that they rotate in opposite directions at substantially the same angular velocity; and applying force to the bed in a selected direction to raise or lower the bed.

20. A method of raising and lowering a bed, comprising:

providing a bed system comprising a bed platform and a balanced movement system, the balanced movement system comprising a counterweight system and a coordinated timing structure, the counterweight system comprising a plurality of counterweights connected to and acting on the bed platform through a like plurality of counterweight chains, the counterweight chains connecting the counterweights and the bed platform by traversing a plurality of counterweight sprockets located on at least two rotatable shafts, the counterweight chains having their own weight that creates a weight differential that opposes movement of the bed when force is applied to the bed to change its resting position, the timing structure comprising at least two right angle gearboxes and a rotatable connecting shaft, each right angle gearbox being connected to the at least two rotatable shafts configured opposite each other, the right angle gearboxes also being connected to the rotatable connecting shaft thereby coordinating the movement of the two rotatable shafts such that they rotate in opposite directions at substantially the same angular velocity; and applying force to the bed in a selected direction to raise or lower the bed.

* * * * *